US012559879B2

(12) United States Patent
Yoon et al.

(10) Patent No.: US 12,559,879 B2
(45) Date of Patent: Feb. 24, 2026

(54) LAUNDRY TREATING APPARATUS

(71) Applicant: LG Electronics Inc., Seoul (KR)

(72) Inventors: Juhan Yoon, Seoul (KR); Jongmin Lee, Seoul (KR); Kangjin Park, Seoul (KR)

(73) Assignee: LG Electronics Inc., Seoul (KR)

( * ) Notice: Subject to any disclaimer, the term of this patent is extended or adjusted under 35 U.S.C. 154(b) by 1023 days.

(21) Appl. No.: 17/690,626

(22) Filed: Mar. 9, 2022

(65) Prior Publication Data

US 2022/0290362 A1 Sep. 15, 2022

(30) Foreign Application Priority Data

Mar. 9, 2021 (KR) ..... 10-2021-0030676

(51) Int. Cl.
*D06F 58/20* (2006.01)
*D06F 58/04* (2006.01)

(52) U.S. Cl.
CPC ..... *D06F 58/20* (2013.01); *D06F 58/04* (2013.01)

(58) Field of Classification Search
CPC ..... D06F 58/08; D06F 58/20; D06F 37/30; D06F 58/02; D06F 58/00; D06F 58/04; F16D 1/108; F16D 2001/103
See application file for complete search history.

(56) References Cited

U.S. PATENT DOCUMENTS

| | | | |
|---|---|---|---|
| 2005/0132600 A1 | 6/2005 | Myung | |
| 2021/0062401 A1 | 3/2021 | Jang et al. | |

FOREIGN PATENT DOCUMENTS

| | | | | |
|---|---|---|---|---|
| CN | 1637201 | | 7/2005 | |
| CN | 104131443 | | 11/2014 | |
| CN | 106868828 | | 6/2017 | |
| CN | 109576963 | | 4/2019 | |
| EP | 0503586 | A1 * | 9/1992 | ..... D06F 58/20 |
| EP | 2843115 | | 3/2015 | |
| EP | 3249093 | A1 | 11/2017 | |
| EP | 3690130 | | 8/2020 | |
| EP | 4039870 | A1 | 8/2022 | |
| EP | 4039876 | B1 | 9/2023 | |
| KR | 20190128529 | | 11/2019 | |
| KR | 10-2020-0065931 | A | 6/2020 | |

(Continued)

OTHER PUBLICATIONS

Extended European Search Report in European Appln. No. 22160963.9, dated Jun. 17, 2022, 9 pages.

(Continued)

*Primary Examiner* — Edelmira Bosques
*Assistant Examiner* — Bao D Nguyen
(74) *Attorney, Agent, or Firm* — Fish & Richardson P.C.

(57) ABSTRACT

A laundry treating apparatus includes: a cabinet including a rear plate at a rear surface, and a drum rotatably disposed inside the cabinet and configured to receive laundry, the drum including a drum rear surface facing the rear plate. The rear plate provides an air flow portion that defines a flow space configured to receive air and that includes an opening at a front surface to provide the received air to the drum rear surface, the drum rear surface provides an air passage configured to receive the air from the air flow portion, and the air flow portion includes an air guide protruding in the flow space and configured to move the air in the air flow portion.

19 Claims, 26 Drawing Sheets

(56) References Cited

FOREIGN PATENT DOCUMENTS

| | | |
|---|---|---|
| KR | 20200065932 | 6/2020 |
| WO | WO2018188334 | 10/2018 |

OTHER PUBLICATIONS

Office Action in Chinese Appln. No. 202210223333.5, mailed on Jan. 27, 2024, 10 pages (with English translation).
Extended European Search Report in European Appln. No. 22160963.9, mailed on Nov. 19, 2024, 6 pages.
Office Action in Korean Appln. No. 10-2021-0030676, mailed on Oct. 20, 2025, 10 pages (with English translation).

* cited by examiner

LAUNDRY TREATING APPARATUS

CROSS-REFERENCE TO RELATED APPLICATION

This application claims priority to and the benefit of Korean Patent Application No. 10-2021-0030676, filed on Mar. 9, 2021, the disclosure of which is incorporated herein by reference in its entirety.

TECHNICAL FIELD

The present disclosure relates to a laundry treating apparatus, and more particularly, to a laundry treating apparatus including a driver connected to a drum for accommodating laundry to rotate the drum.

BACKGROUND

A laundry treating apparatus, which is an apparatus for performing various treating processes on laundry, such as washing, drying, or the like of the laundry, includes a washing machine, a dryer, a refresher (a styler), and the like.

The washing machine is constructed to perform a washing process for separating and removing foreign matters of the laundry by supplying water and detergent to the laundry. The dryers may be divided into exhaust-type dryers and circulation-type dryers. Both of the exhaust-type dryers and the circulation-type dryers are constructed to perform a drying process to remove moisture contained in the laundry by heating air and providing hot air to the laundry.

The laundry treating apparatus may include the driver for rotating a drum, and the driver may be connected to the drum in various schemes to provide a rotation force.

A conventional laundry treating apparatus can include a driver that is disposed inside and a lower portion of a cabinet and that is connected using a drum belt.

The conventional laundry treating apparatus corresponds to the dryer for drying the laundry, and includes a circulation flow channel that receives air from the drum and provides the air to the drum again, and a heat pump that is connected to the circulation flow channel to heat the air.

In the laundry treating apparatus, because a driving shaft of the driver and a rotation shaft of the drum are not located on the same line, power of the driver is provided to the drum using a separate power transmission medium such as a belt and the like.

When the driver is placed on a bottom surface of the cabinet and provides the rotation force to the drum using the belt, because a diameter difference between the driving shaft and the drum is large, a separate transmission for increasing torque, such as a reducer, may be omitted.

However, when the rotation force is provided from the driver to the drum using the belt, slip easily occurs between the belt and the driver or between the belt and the drum by a rotation speed of the driving shaft or an inertia of the drum.

Therefore, the laundry treating apparatus may be disadvantageous in terms of efficiency by the slip and the like, and is disadvantageous to apply an efficient drum rotation strategy because there may be restrictions in changing the rotation speed or a rotation direction of the driving shaft.

Furthermore, the laundry treating apparatus may be disadvantageous because there is a constraint on an arrangement of the components and there is a restriction on a space that may be allocated to each component because the driver is disposed at the same time as an air circulator and the heat pump are disposed on a base disposed at a lower portion of the cabinet, for example, at a bottom surface of the cabinet.

In one example, unlike the laundry treating apparatus, the driver may be disposed at the rear of the drum rather than at the lower portion of the cabinet and connected to the drum. In this case, a component such as the belt for connecting the driver and the drum to each other may be omitted.

A conventional laundry treating apparatus can also include the driver fixed to a rear surface of the cabinet.

The conventional laundry treating apparatus may be constructed such that the driver is disposed at the rear of the drum to rotate the drum. Therefore, the driving shaft of the driver and the rotation shaft of the drum may be positioned on the same line, so that the driver may directly rotate the drum without using the belt or the like.

Accordingly, the slip phenomenon occurring in the belt or the like may be solved and the rotation of the driving shaft may be directly transmitted to the drum, which may be advantageous in establishing the rotation strategy of the drum.

However, the laundry treating apparatus corresponds to the dryer, and unlike the washing machine, there is no tub in which the drum is embedded and water is accommodated. Thus, the driver is coupled to a rear panel of the cabinet at the rear of the drum.

Furthermore, the laundry treating apparatus may include a flow portion of air for supplying air into the drum at the rear of the drum to supply the air into the drum to dry the laundry and to supply the air smoothly into the rotating drum.

Accordingly, in the laundry treating apparatus, the air flow portion is disposed at the rear of the drum together with the driver, and it is an important task to design the rear surface of the cabinet including the driver and the air flow portion.

A conventional laundry treating apparatus can also include the driver coupled to the rear surface of the cabinet located at the rear of the drum, and the flow portion of the air that faces a rear surface of the drum and flows the air toward the rear surface of the drum is disposed.

In the conventional laundry treating apparatus, the driver is coupled onto the rear surface of the cabinet facing a center of the rear surface of the drum, and the flow portion through which the air flows is disposed around the driver.

The flow portion is constructed as a duct in which a space through which air flows is defined is coupled onto the rear surface of the cabinet, and the rear surface of the cabinet includes a plurality of holes defined forwardly of the duct to allow the air in the duct to be supplied to the rear surface of the drum.

However, because a separate duct member protruding rearwards from the rear surface of the cabinet is coupled to define the flow portion, the laundry treating apparatus is disadvantageous as additional fastening for the coupling of the duct member may be needed and air leakage between the duct member and the rear surface of the cabinet may occur.

In addition, because the plurality of holes are defined in the rear surface of the cabinet in the front of the duct member, a punching process of the cabinet must be added. Furthermore, a flow of air in a forward direction is obstructed in a region other than the hole, so that it is disadvantageous in supplying air to the rear surface of the drum.

In one example, in a process of drying the laundry by supplying hot air into the drum, when a flow of air inside the flow portion of the rear plate is unstable or has a poor uniformity, a drying efficiency of the laundry may be adversely affected.

Furthermore, it may be advantageous for the hot air to be intensively supplied to a specific region inside the drum based on a behavior of the laundry inside the drum or rotation characteristics of the drum. That is, strategically setting a region where the air intensively leaks from the flow portion of the air may effectively improve the drying efficiency of the laundry.

Therefore, it is an important task in the present technical field to develop an air flow portion of an efficient structure for supplying the air from the rear plate to the drum, improve fluidity of the air in the air flow portion, and control a flow direction of the air with an efficient scheme.

SUMMARY

The present disclosure is directed to a laundry treating apparatus in which a driver and a drum are directly connected to each other to effectively transmit power of the driver and to which an efficient rotation scheme of the drum can be applied.

The present disclosure is also directed to a laundry treating apparatus including an air flow portion of an efficient structure for supplying air from a rear plate into a drum.

The present disclosure is also directed to a laundry treating apparatus that can effectively increase a space inside a cabinet and effectively increase a capacity of a drum.

The present disclosure is also directed to a laundry treating apparatus capable of effectively improving fluidity of air by efficiently guiding a flow of air flowing along an air flow portion.

The present disclosure is also directed to a laundry treating apparatus capable of efficiently guiding an inflow direction of air flowing into an air flow portion through an inflow guide of the air flow portion.

The present disclosure is also directed to a laundry treating apparatus capable of suppressing or limiting a turbulent flow of air flowing through an air flow portion through an outflow guide of the air flow portion and improving an outflow uniformity of the air or effectively forming an outflow concentration region.

According to one aspect of the subject matter described in this application, a laundry treating apparatus can include a cabinet including a rear plate at a rear surface, and a drum rotatably disposed inside the cabinet and configured to receive laundry, the drum including a drum rear surface facing the rear plate. The rear plate can provide an air flow portion that defines a flow space configured to receive air and that includes an opening at a front surface to provide the received air to the drum rear surface, the drum rear surface can provide an air passage configured to receive the air from the air flow portion, and the air flow portion can include an air guide protruding in the flow space and configured to move the air in the air flow portion.

Implementations according to this aspect can include one or more of the following features. For example, the air guide can include an outflow guide protruding toward the air passage from a flow recessed surface, the flow recessed surface covering the flow space from a rear side of the air flow portion and configured to move the air in the flow space toward the air passage.

In some implementations, the air flow portion can include (i) a flow outer circumferential surface extending along an outer circumference of the flow space and (ii) a flow inner circumferential surface extending along an inner circumference of the flow space, and the outflow guide can be connected to the flow outer circumferential surface and the flow inner circumferential surface. In some examples, the air passage can face the air flow portion, and a portion of the flow recessed surface curved toward the air passage can be the outflow guide.

In some examples, the rear plate can further include a driver mounting portion (i) coupled to a driver from a rear side of the rear plate and (ii) surrounded by the air flow portion, the driver configured to provide a rotational force to the drum, the rear plate includes a power line connected the driver mounting portion, configured to provide power to the driver, and provided at the rear side of the rear plate, and the outflow guide can be recessed frontward from a rear surface of the rear plate to define a space configured to receive the power line in the rear surface of the rear plate. In some implementations, the outflow guide can include a guide central portion protruding from the flow recessed surface toward the air passage, and a guide inclined portion extending from the guide central portion along a circumferential direction of the air flow portion, the guide inclined portion having a height of protrusion from the flow recessed surface decreasing as a distance from the guide central portion increases.

In some implementations, the laundry treating apparatus can further include an air supply disposed inside the cabinet and configured to move air to the air flow portion, the rear plate can further include an inlet extension extending from the air flow portion toward the air supply and configured to move the air in the air supply toward the air flow portion, and the outflow guide can include a first outflow guide located on a side opposite to the inlet extension with respect to a center of the air flow portion having an annular shape. In some examples, a maximum protrusion height of the first outflow guide can be equal to or greater than a depth of the flow space.

In some examples, the outflow guide can further include a second outflow guide disposed between the inlet extension and the first outflow guide and configured to move the air in the flow space toward the air passage. In some examples, the air flow portion can include a first extended flow channel extending from the inlet extension to the first outflow guide along a first direction, and a second extended flow channel extending from the inlet extension to the first outflow guide along a second direction, an amount of air supplied to the second extended flow channel through the inlet extension can be less than an amount of air supplied to the first extended flow channel, and the second outflow guide can be disposed on the second extended flow channel. In some examples, a first distance between a discharge space for discharging the air from the inlet extension to the flow space and the first extended flow channel can be less than a second distance between the discharge space and the second extended flow channel.

In some implementations, a maximum protrusion height of the second outflow guide can be less than a depth of the flow space. In some implementations, a maximum protrusion height of the second outflow guide can be less than a maximum protrusion height of the first outflow guide.

In some implementations, the laundry treating apparatus can further include an air supply disposed inside the cabinet and configured to move air to the air flow portion, the rear plate can further include an inlet extension extending from the air flow portion toward the air supply and configured to move the air in the air supply toward the air flow portion, and the air flow portion can include an inflow guide facing the inlet extension and configured to move the air discharged from the air supply toward the air flow portion. In some examples, the air flow portion can include a flow inner circumferential surface having an annular shape and extending along an inner circumference of the flow space, and the inflow guide can be disposed on the flow inner circumferential surface and protrudes toward the air supply.

In some examples, a portion of the flow inner circumferential surface can protrude toward the air supply to define the inflow guide in the air flow portion. In some examples, a portion of the flow inner circumference surface corresponding to the inflow guide can extend in a straight line and a remaining portion of the flow inner circumference surface can extend in a curved line.

In some implementations, the air flow portion can include a first extended flow channel extending from the inlet extension along a first direction, and a second extended flow channel extending from the inlet extension along a second direction, an amount of air supplied to the first extended flow channel through the inlet extension can be greater than an amount of air supplied to the second extended flow channel, and the inflow guide can be configured to move a portion of air flowing toward the first extended flow channel toward the second extended flow channel. In some examples, the laundry treating apparatus can further include a driver coupled to the rear plate and configured to provide a rotational force to the drum, the driver can be configured to rotate the drum such that an amount of rotation in the second direction of the drum is greater than an amount of rotation in the first direction of the drum in a drying process of the laundry, and, based on the drum being rotated in the second direction, the air in the first extended flow channel flowing along the first direction can be introduced into the drum.

In some implementations, the air flow portion can include a flow outer circumferential surface extending along an outer circumference of the flow space, and a width of the first extended flow channel can be less than a width of the second extended flow channel.

DETAILED DESCRIPTION

Figure 1:
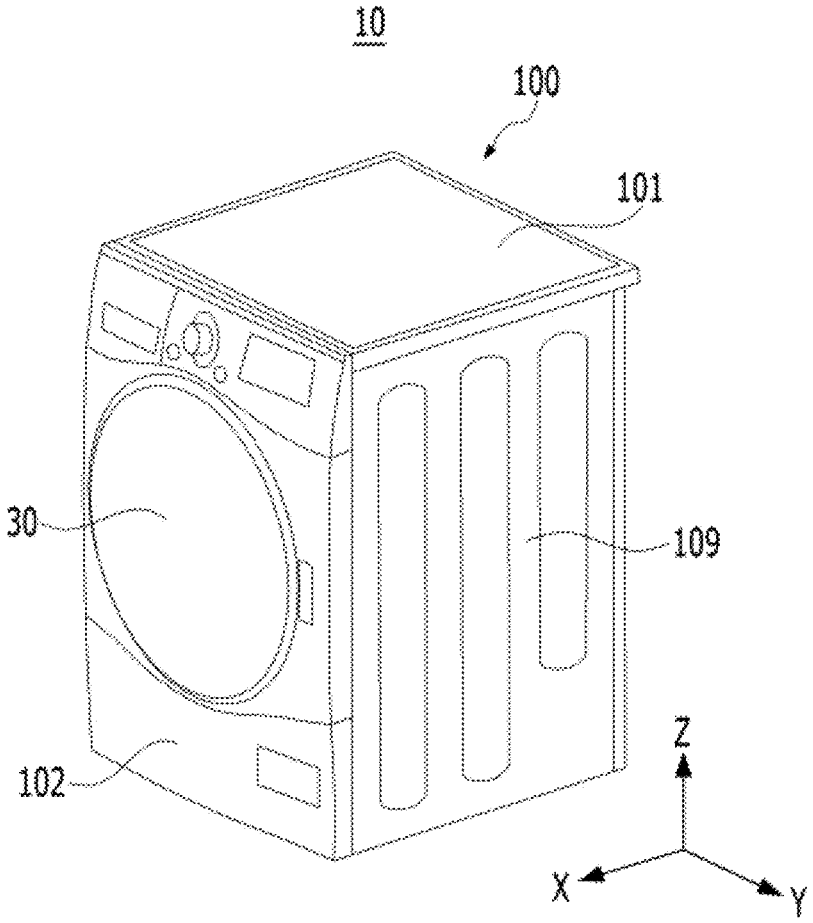
FIG. 1 is a diagram illustrating an exemplary laundry treating apparatus.
Figure 2:
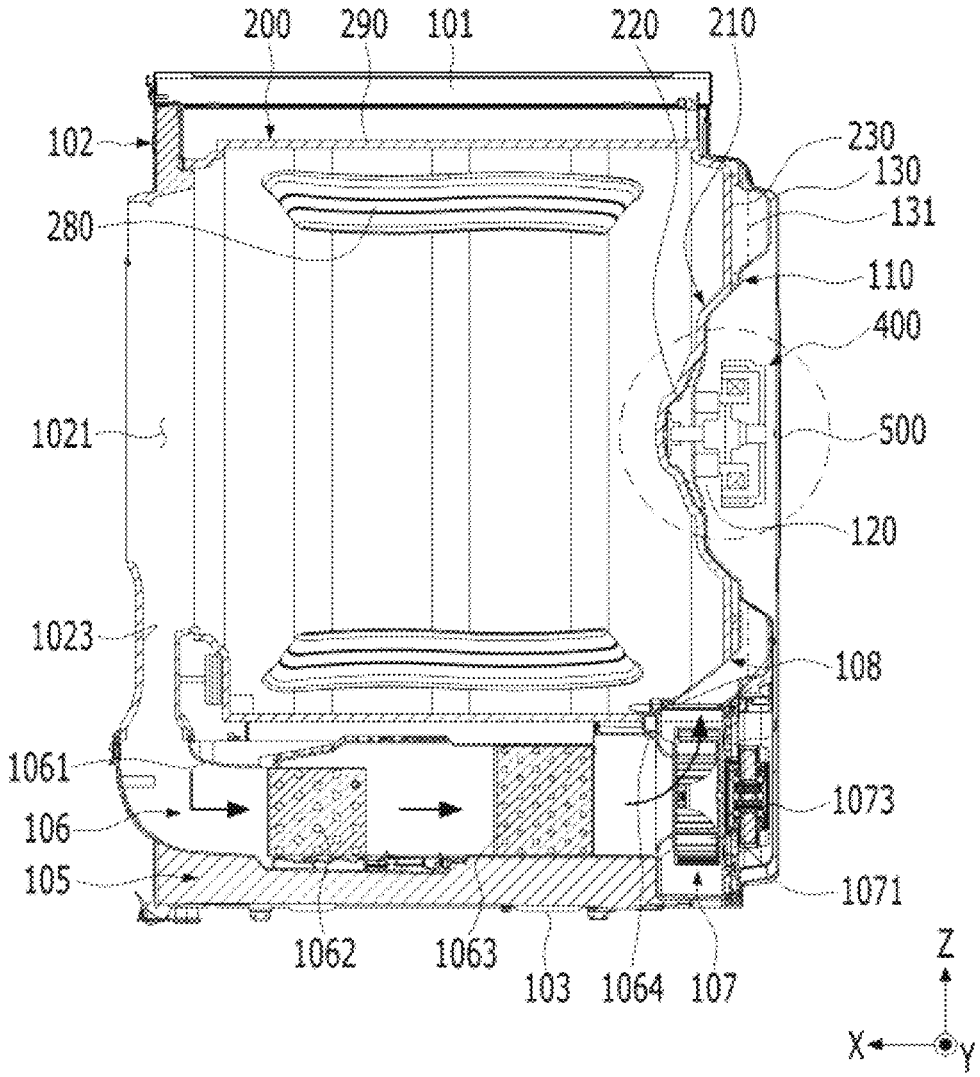
FIG. 2 is a diagram illustrating an internal cross-section of an exemplary laundry treating apparatus.

Referring to FIGS. 1 and 2, a laundry treating apparatus 10 can include a cabinet 100 that defines an appearance of the laundry treating apparatus 10.

The cabinet 100 can have a front plate 102 at a front surface thereof, side plates 109 at both surfaces in a lateral direction, respectively, a top plate 101 at a top surface thereof, a bottom plate 103 at a bottom surface thereof, and a rear plate 110 at a rear surface thereof.

The front plate 102, the side plates 109, and the rear plate 110 can be provided in a shape extending upward from the ground or the bottom plate 103 in a vertical direction.

The plates can provide a connection relationship with each other, and together provide the cabinet 100. The plates can be connected together to define a space in which a drum 200 and similar components of the laundry treating apparatus 10 are disposed.

The front plate 102 can form the front surface of the cabinet 100, and can be formed with a laundry inlet 1021 for putting laundry into the apparatus. The laundry inlet 1021 can be defined at a central portion of the front plate 102, and a laundry door 30 for opening and closing the laundry inlet can be disposed on the front plate 102.

The front plate 102 can include a control panel, and the control panel can include a manipulation unit to which a manipulation signal can be input by a user, a display capable of displaying a treating process of the laundry, and the like.

However, the control panel is not necessarily disposed on the front plate 102, and is able to be disposed on the top plate 101 or the like. In addition, a plurality of control panels can be respectively disposed on the front plate 102, the top plate 101, and the like.

The laundry treating apparatus 10 can perform a drying process of the laundry, and the manipulation unit can be configured to receive a command to perform the drying process from the user.

In some implementations, the laundry treating apparatus 10 can include a controller. The controller can be spaced apart from an interior of the control panel or from the control panel and signally connected to the control panel. The controller can be signally connected to the control panel and a driver 400 to perform the drying process of the laundry while controlling the driver 400.

The top plate 101 can define the top surface of the cabinet 100 and can shield an interior of the cabinet 100 from the top of the cabinet 100. The side plates 109 can define the both side surfaces of the cabinet 100 in the lateral direction, respectively. For example, the side plates 109 can include a first side plate defining one side surface in the lateral direction Y of the cabinet 100 and a second side plate defining the other side surface in the lateral direction of the cabinet 100.

The bottom plate 103 can define the bottom surface of the cabinet 100, and an air supply 106 and a heat pump can be disposed on the bottom plate 103. The rear plate 110 can define the rear surface of the cabinet 100, and an air flow portion 130, a driver mounting portion 120, and the like can be disposed on the rear plate 110.

In some implementations, referring to FIG. 2, the drum 200 can have a drum front surface at a front surface thereof, and a drum inlet for putting the laundry into the drum can be defined in the drum front surface.

The laundry put into the cabinet 100 through the laundry inlet 1021 defined in the front plate 102 can be put into the drum 200 through the drum inlet. The drum 200 can be formed in a shape in which an entirety of the drum front surface is opened to define the drum inlet.

A drum circumferential surface 290 surrounding an inner space of the drum 200 can be disposed at the rear of the drum front surface, and a drum rear surface 210 can be disposed at the rear of the drum circumferential surface 290. The drum rear surface 210 can have an edge coupled to the drum circumferential surface 290.

A space defined by the drum circumferential surface 290 and the drum rear surface 210 can be defined in the drum 200. The space inside the drum 200 can communicate with the outside through the drum inlet, can be surrounded by the drum circumferential surface 290, and can be shielded from the rear by the drum rear surface 210.

In some implementations, the drum 200 can be of a front loader type in which a rotation shaft extending along a front and rear direction is included and the laundry is put into the drum 200 from the front. It can be relatively easy to put and withdraw the laundry into and from the drum 200 in the front loader type compared to a top loader type.

In some implementations, the front plate 102 can rotatably support the drum 200. That is, the front plate 102 can rotatably support a front end of the drum 200. The front end of the drum 200 can be accommodated in and supported by the front plate 102.

For example, the front plate 102 can support the front end of the drum 200 from a circumference of the laundry inlet 1021 to the rear. Accordingly, the laundry inlet 1021 and the drum inlet are disposed to face each other, and the laundry inlet 1021 and the interior of the drum 200 can be in communication with each other.

In some implementations, the front plate 102 can include a gasket surrounding at least a portion of the laundry inlet 1021 by extending along a circumference of the laundry inlet 1021.

The gasket can rotatably support the front end of the drum 200, and can block or suppress air leakage to the outside between the front plate 102 and the drum inlet or between the laundry inlet 1021 and the drum inlet.

The gasket can be made of a plastic resin-based material or an elastic material, and a separate sealing member can be additionally coupled to an inner circumferential surface of the gasket.

In some implementations, a front wheel in contact with the front end of the drum 200 to rotatably support the drum 200 can be installed on the front plate 102. The front wheel can be constructed to support an outer circumferential surface of the drum inlet, and a plurality of front wheels can be disposed spaced apart from each other along the circumference of the laundry inlet 1021.

The front wheel can support the drum 200 upward from a lower portion of the front end of the drum 200, and can rotate together by rotation of the drum 200 to minimize friction.

In some implementations, air for the drying of the laundry put into the drum 200, for example, hot air heated to increase in a temperature can be supplied into the drum 200, and the air supplied into the drum 200 can be discharged out of the drum 200 again while containing moisture of the laundry.

In some implementations, the laundry treating apparatus 10 can correspond to the circulation-type laundry treating apparatus in which, after the air that is supplied into the drum 200 in the drying process of the laundry is discharged, the air is dehumidified and heated again and then is supplied into the drum 200.

For example, the laundry treating apparatus 10 can include a circulation flow channel from which the air is supplied into the drum 200, and from which the air discharged from the interior the drum 200 is and re-supplied to the drum 200 after being dehumidified and heated. The drum 200 and air supply 106 can be included on the circulation flow channel, so that the air can be circulated. The air supply 106 can be constructed to dehumidify and heat the air discharged from the drum 200 and supply the air back to the drum 200.

In some implementations, the air can be introduced into the drum 200 through the drum rear surface 210, and the air inside the drum 200 can be discharged out of the drum 200 again through the drum inlet of the drum front surface.

In some implementations, the front plate 102 can include a front duct 1023. The front duct 1023 can be disposed on the front plate 102 to deliver air discharged from the drum 200 to the air supply 106.

The front duct 1023 can be constructed to be in communication with the drum inlet or the laundry inlet 1021, and can be disposed inside the front plate 102 or can be in communication with the laundry inlet 1021 through the gasket from the outside of the front plate 102.

FIG. 2 shows the front duct 1023 disposed inside the front plate 102.

Referring to FIG. 2, the drum 200 can be connected to the drum inlet and the laundry inlet 1021 to maintain airtightness through the above-described gasket, sealing member, and the like. The front duct 1023 can be constructed to be in communication with the laundry inlet 1021 and the drum inlet such that the air discharged from the drum 200 is introduced.

The front duct 1023 can extend inside the front plate 102 to discharge air out of the front plate 102, that is, into the cabinet 100. In some implementations, the air supply 106 can be disposed inside the cabinet 100, and the air supply 106 can be connected to the front duct 1023 to receive the air discharged from the front duct 1023.

Referring to FIG. 2, the air supply 106 can be disposed inside the cabinet 100, and can be disposed on the bottom plate 103 where securing a space is relatively easy. A base 105 on which the air supply 106 or the heat pump is disposed can be disposed on top of the bottom plate 103.

The air supply 106, the heat pump, and the like can be seated on the base 105, and the base 105 can be coupled to the bottom plate 103 or formed integrally with the bottom plate 103. For example, the base 105 can correspond to the bottom plate 103 to define the bottom surface of the cabinet 100.

The air supply 106 can include an inlet duct 1061. The inlet duct 1061 can be connected to the front duct 1023 to receive the air of the front duct 1023. The inlet duct 1061 and the front duct 1023 can be separately manufactured and coupled to each other, or can be formed integrally with each other as one body.

Air introduced into the air supply 106 through the inlet duct 1061 from the front duct 1023 can be dehumidified and heated and discharged from the air supply. The air supply 106 can have some of components of the heat pump embedded therein for the dehumidification and the heating of the air.

The air introduced through the inlet duct 1061 can flow inside the air supply 106 and be discharged from the air supply 106 through an outlet duct 1064. The air supply 106 can further include a blower 107 connected to the outlet duct 1064.

The blower 107 can discharge the air to the outside of the air supply 106 while forming a flow of the air in an entirety of the circulation flow channel described above through a blower fan 1071 rotated by a blower motor 1073.

For example, the air may be introduced into the air supply 106 through the inlet duct 1061 connected to the front duct 1023, and the air passing through the interior of the air supply 106 can be dehumidified and heated, and the dehumidified and heated air can be discharged to the outside of the air supply 106 through the outlet duct 1064 and the blower 107.

In some implementations, the rear plate 110 can include the air flow portion 130 for supplying air discharged from the blower 107 to the drum rear surface 210. For example, the air supply 106 can provide the air to the drum rear surface 210 through the air flow portion 130 by discharging the air to the air flow portion 130.

The air supply 106 can further include a fan duct 108 connected to the blower 107, and the fan duct 108 can connect the blower 107 and the air flow portion 130 to each other. For example, the air discharged through the blower 107 can be supplied to the air flow portion 130 via the fan duct 108.

The rear plate 110 can further include an inlet extension 138 extending from the air flow portion 130 (see FIG. 4), and the air supply 106 can be connected to the inlet extension 138 to provide the air to the air flow portion 130.

In the air flow portion 130, the air supplied from the air supply 106 can flow inside and flow out toward the drum rear surface 210. The air flow portion 130 can have an open front surface 131 to allow the air to flow out frontwards. The drum rear surface 210 can have an air passage 230 to which the air flowed out from the air flow portion 130 is introduced. The air passage 230 can be constructed such that the air flowed out from the air flow portion 130 flows into and passes through the air passage 230 to be supplied into the drum 200.

Referring to FIG. 2, a circulation process of the air through the circulation flow channel will be described as follows.

When the drying process of the laundry is performed, the air flowed out from the air flow portion 130 can be supplied into the drum 200 through the air passage 230.

The air supplied into the drum 200 can be dehumidified and heated hot air, and the hot air can dry the laundry by evaporating the moisture present in the laundry inside the drum 200.

The air with increased humidity inside the drum 200 can be discharged to the outside of the drum 200 through the drum inlet, and the air flowing out of the drum 200 can be supplied to the air supply 106 through the front duct 1023.

The air supply 106 can receive the air through the inlet duct 1061 connected to the front duct 1023, and dehumidify and heat the air delivered from the drum 200 using the heat pump or similar devices.

The dehumidified and heated air of the air supply 106 flows into the fan duct 108 via the blower 107 through the outlet duct 1064, and the air flow portion 130 supplies the air introduced through the fan duct 108 back into the drum 200 through the air passage 230 of the drum 200.

The air circulation process as above can be performed continuously, low-humidity and high-temperature air can be continuously provided into the drum 200 through such process, and the moisture present in the laundry can be evaporated by the low-humidity and high-temperature air and be discharged to the outside of the drum 200 together with the air, so that the dry of the laundry can be performed.

Structures of the rear plate 110 and the drum rear surface 210 will be schematically described with reference to FIG. 2 as follows.

The rear plate 110 can include the driver mounting portion 120 and the air flow portion 130. The driver 400 can be coupled to the driver mounting portion 120, and a shape of the driver mounting portion 120 and a coupling form of the driver 400 may vary.

For example, as shown in FIG. 2, the driver mounting portion 120 can include a space open rearwards, and the driver 400 can be at least partially inserted into the driver mounting portion 120 from the rear of the driver mounting portion 120 and can be coupled to the driver mounting portion 120.

The air flow portion 130 can supply air into the drum 200 by providing the air to the drum rear surface 210. A shape of the air flow portion 130 or a providing scheme of air can vary.

Figure 4:
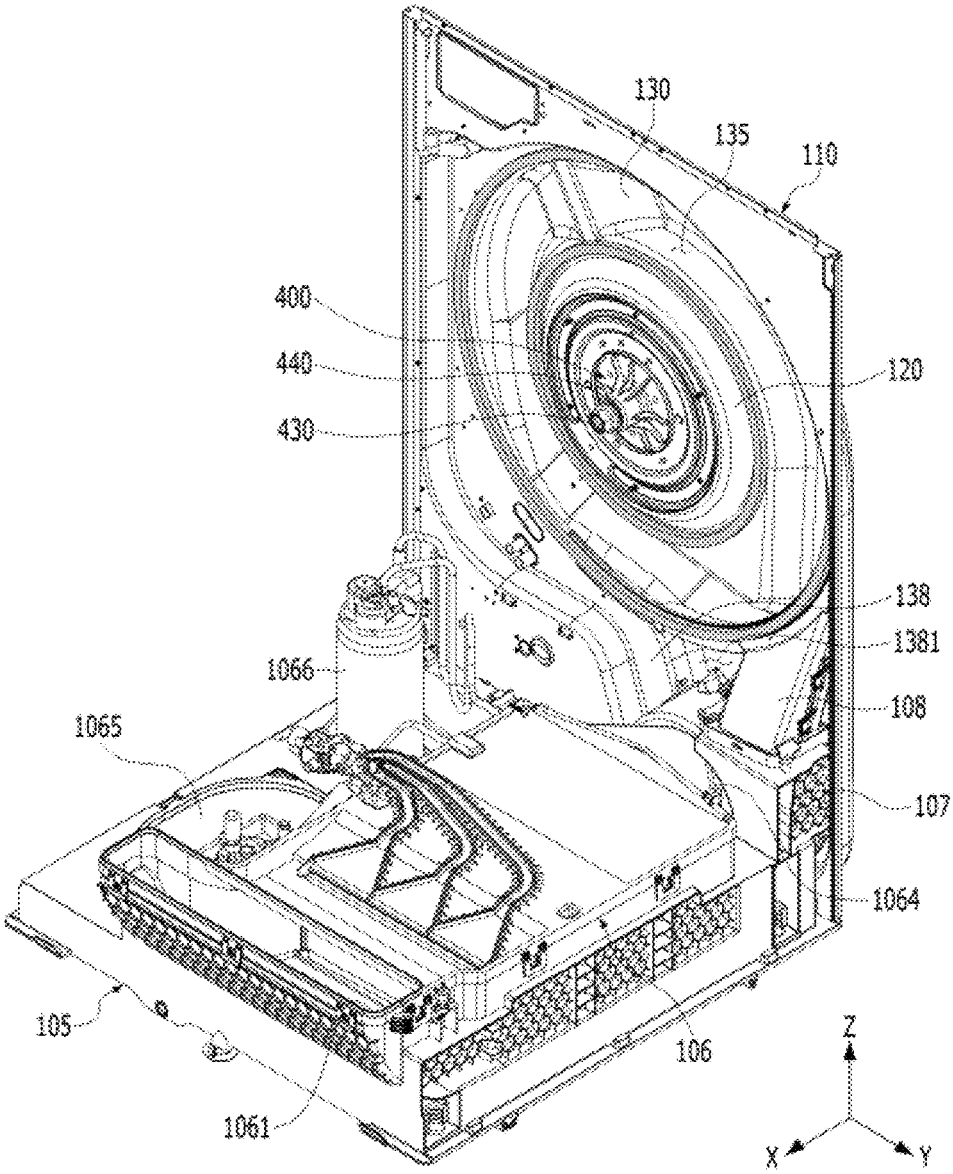
FIG. 4 is a diagram illustrating an example of a base and a rear plate.

For example, the air flow portion 130 can include a flow space 135 through which the air flows (see FIG. 4). As the front surface 131 is opened, the air in the flow space 135 can flow out toward the drum rear surface 210 through the open front surface 131.

In some implementations, the drum rear surface 210 can include a driver connection portion 220 and an air passage 230. The driver connection portion 220 can be connected to the driver 400 coupled to the driver mounting portion 120, so that a rotational force can be supplied from the driver 400.

A shape or a form of connection with the driver 400 of the driver connection portion 220 can vary. For example, as shown in FIG. 2, the driver connection portion 220 can be connected to the driving shaft 430 of the driver 400 to receive power from the driving shaft 430.

The driver connection portion 220 can be positioned to face the driver mounting portion 120 from the front of the driver mounting portion 120, and can be connected with the driving shaft 430 of the driver 400 extending through the driver mounting portion 120.

The air passage 230 can receive the air flowing out from the air flow portion 130. The air flowing out from the air flow portion 130 can flow through the air passage 230 and into the drum 200.

A shape of the air passage 230 or an air inflow scheme can vary. For example, as shown in FIG. 2, the air passage 230 can have a shape corresponding to at least a portion of the air flow portion 130 and can be disposed to face the air flow portion 130 from the front.

Figure 13:
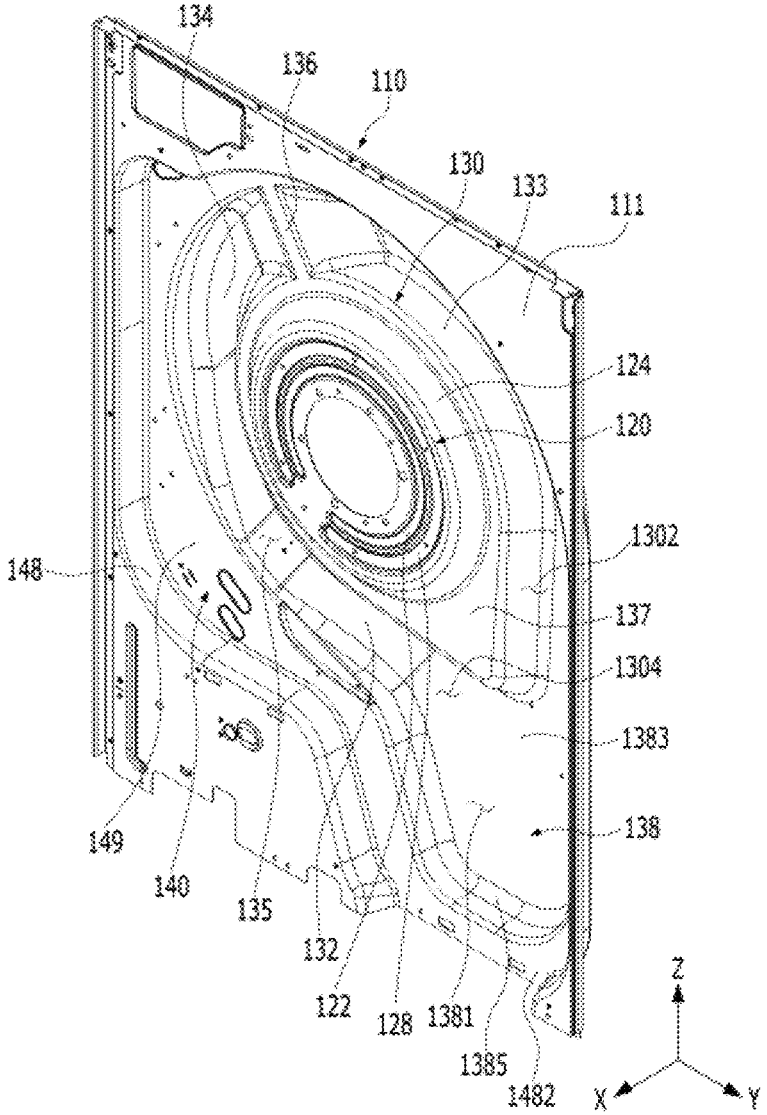
FIG. 13 is a diagram illustrating a rear plate in an exemplary laundry treating apparatus.

The air passage 230 can include a plurality of ventilation holes 234 for the air to pass through, and the air flowing out from the open front surface 131 of the air flow portion 130 can be supplied into the drum 200 through the ventilation holes 234 of the air passage 230 (see FIG. 13).

In some implementations, as the driver 400 rotating the drum 200 is coupled to the driver mounting portion 120 of the rear plate 110, the rotation shaft of the drum 200 and the driving shaft 430 of the driver 400 can be disposed on the same line.

Therefore, the driver 400 can rotate the drum 200 without using a connecting member such as a belt or the like, so that it is possible to actively and effectively adjust a rotation speed and a rotation direction of the drum 200 without an occurrence of a slip resulted from the belt.

In some implementations, a portion of the rear plate 110 itself can form the air flow portion 130, so that the air flow portion 130 can be effectively formed without adding a separate component for forming the air flow portion 130.

For example, the air flow portion 130 can block the air from leaking from a coupling portion between the components because the separate component is not coupled to the rear plate 110, and coupling between the components for forming the air flow portion 130 may not be required, which may be advantageous in the manufacturing process.

In some implementations, the front surface 131 of the air flow portion 130 can be formed in the open shape. Accordingly, it is possible to effectively improve flow of air from the interior of the air flow portion 130 toward the drum rear surface 210.

Figure 3:
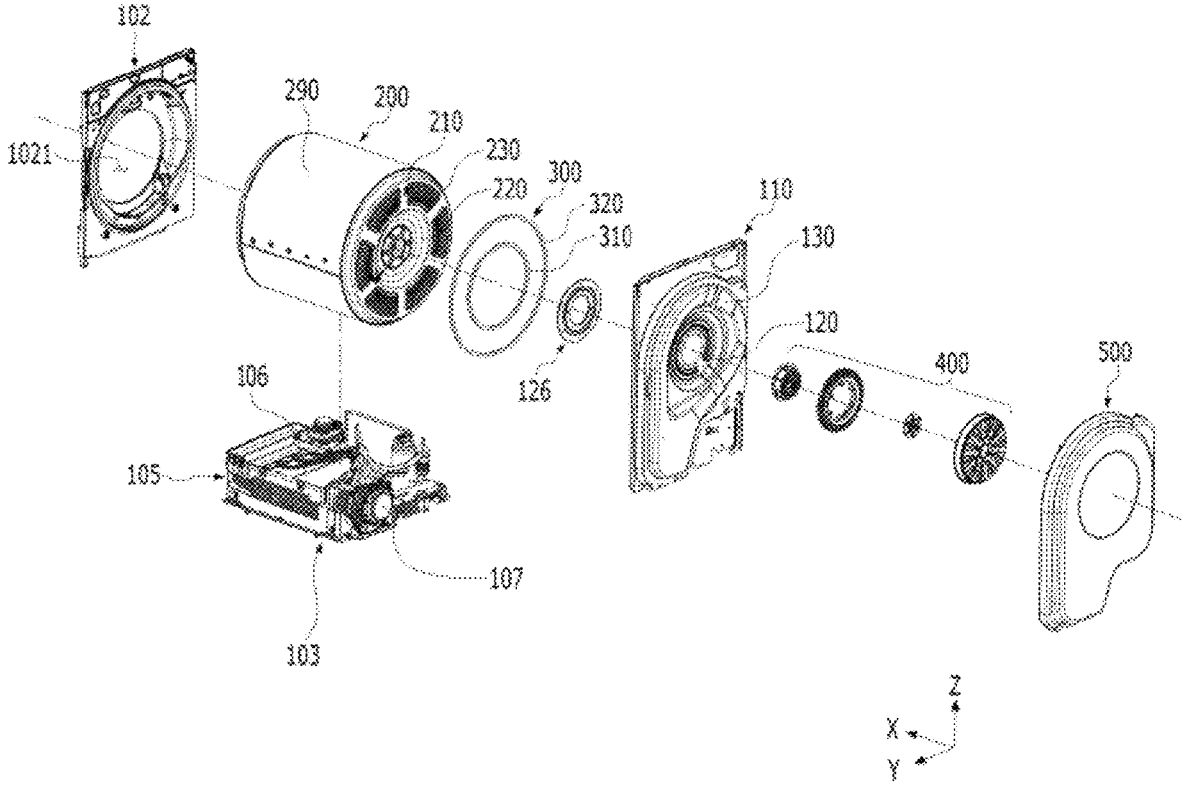
FIG. 3 is a diagram illustrating an exploded state of an exemplary laundry treating apparatus.

FIG. 3 is a diagram illustrating an exploded view of the laundry treating apparatus 10. With reference to FIG. 3, the components that may be included in the laundry treating apparatus 10 will be schematically described as follows.

The front plate 102 can include the laundry inlet 1021 defined at the front surface of the cabinet 100 to form a front appearance of the cabinet 100 and through which the laundry can be put into the cabinet 100.

The drum 200 can be disposed at the rear of the front plate 102, the drum 200 can rotate around a rotation shaft disposed in the front and rear direction and can have the open front surface to define the drum inlet, and the laundry put into the cabinet 100 through the laundry inlet 1021 can be put into the drum 200 through the drum inlet.

The drum 200 can include an inlet circumference surrounding the drum inlet, the drum circumferential surface 290 surrounding the interior of the drum 200 at the rear of the inlet circumference, and the drum rear surface 210 coupled to the drum circumferential surface 290 at the rear of the drum circumferential surface 290.

The rear plate 110 can be disposed at the rear of the drum 200. The rear plate 110 can be located at a rear portion of the cabinet 100 to form at least a portion of a rear appearance of the cabinet 100.

The rear plate 110 can include the air flow portion 130 for providing the air into the drum 200, and a rear sealer 300 for blocking or suppressing air leakage can be disposed between the drum rear surface 210 and the air flow portion 130.

In some implementations, the air flow portion 130 can be formed in an approximately annular shape, and the rear sealer 300 can include an inner sealer 310 and an outer sealer 320.

The inner sealer 310 can block air from leaking from an inner circumference of the air flow portion 130 to the outside of the air passage 230, and the outer sealer 320 can block air from leaking to the outside of the air passage 230 while surrounding an outer circumference of the air flow portion 130.

In some implementations, the rear plate 110 can include the driver mounting portion 120 on which the driver 400 is mounted, and a mounting bracket 126 can be coupled to the driver mounting portion 120 from the front, and the driver 400 can be coupled to the driver mounting portion 120 from the rear.

The mounting bracket 126 can be coupled to the front surface of the driver mounting portion 120 to reinforce rigidity of the driver mounting portion 120 to which the driver 400 is coupled, and can strengthen a coupling force of the driver 400 and suppress vibrations or the like that may occur from the driver 400.

When the driver 400 is directly connected to the drum 200 by being coupled to the rear plate 110, it is important that the driver 400 is stably fixed, so that the driving shaft 430 of the driver 400 and the rotation shaft of the drum 200 are aligned. Therefore, in some implementations, the mounting bracket 126 can be coupled to the front surface of the driver mounting portion 120 to reinforce the driver mounting portion 120 and to enhance the coupling force of the driver 400.

The driver 400 coupled to the driver mounting portion 120 from the rear of the driver mounting portion 120 can also form a coupling relationship with the mounting bracket 126 through the driver mounting portion 120. For example, the mounting bracket 126, the driver mounting portion 120, and the mounting bracket 126 can form a mutually fastening relationship.

The driving shaft 430 of the driver 400 can pass through the driver mounting portion 120 to be connected to the driver connection portion 220 of the drum rear surface 210. The driver 400 can include a first driving part 410 directly coupled to the driver mounting portion 120, and a second driving part 420 coupled to the first driving part 410, and the driving shaft 430 can extend forward from the first driving part 410.

In some implementations, a rear cover 500 can be disposed at the rear of the rear plate 110. The rear cover 500 can be constructed to cover at least a portion of the rear plate 110 from the rear, and can be coupled to the rear plate 110.

The rear cover 500 can form an entirety of the rear surface of the laundry treating apparatus 10, or can form the rear surface of the laundry treating apparatus 10 together with the rear plate 110 while exposing a portion of the rear plate 110.

In some implementations, the air flow portion 130 of the rear plate 110 or the driver 400 can be at least partially exposed rearwardly from the rear plate 110, and the rear cover 500 can be coupled onto the rear surface of the rear plate 110 to shield or cover the air flow portion 130 and the driver 400 from the outside.

Accordingly, in some implementations, the laundry treating apparatus 10 can suppress an occurrence of heat loss of the air resulted from heat transfer from the air flow portion 130 to the outside through the rear cover 500, and can protect or cover the air flow portion 130 from the outside. In addition, the driver 400 can be shielded or covered from the outside by the rear cover 500 and can be protected or covered from impacts or foreign matters that can be transmitted from the outside.

In some implementations, the base 105 can be disposed below the drum 200 inside the cabinet 100, and the air supply 106, the heat pump, and similar components can be disposed on the base 105.

The air supply 106 can dehumidify and heat the air discharged from the drum 200 and supply the air back into the drum 200 through the air flow portion 130. At least a portion of the heat pump can be disposed inside the air supply 106 to dehumidify and heat the air flowing through the air supply 106.

Figure 5:
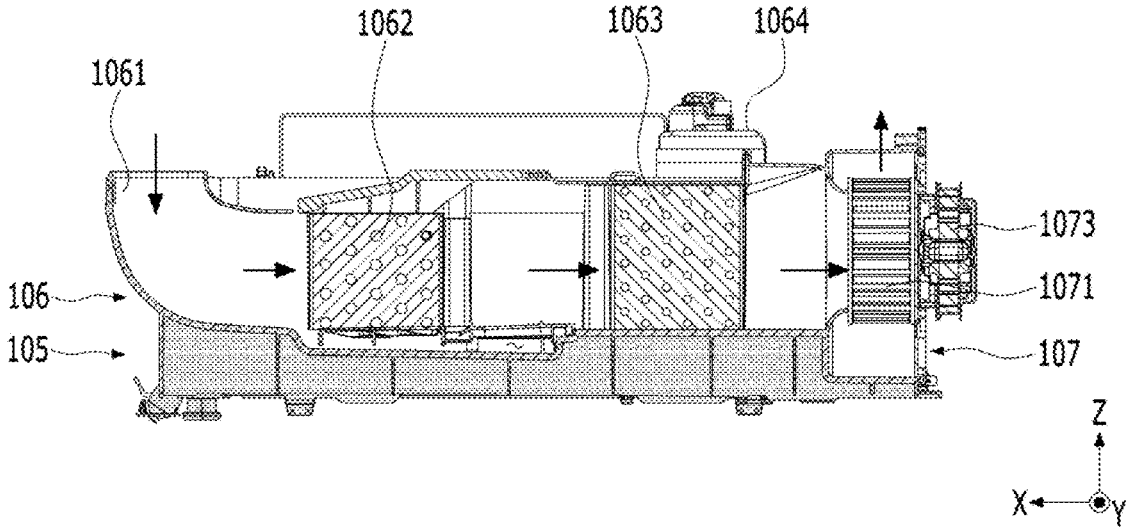
FIG. 5 is a diagram illustrating a cross-section of an air supply in an exemplary laundry treating apparatus.

FIG. 4 is a diagram illustrating the air supply 106 of the base 105 and the air flow portion 130 of the rear plate 110 connected to each other, and FIG. 5 is a diagram illustrating a cross-section of the air supply 106.

The air supply 106 and the heat pump will be described in detail with reference to FIGS. 4 to 6 as follows.

FIG. 4 shows the base 105 disposed at the bottom surface of the cabinet 100, and shows the inlet duct 1061 connected to the front duct 1023 of the front plate 102 from the air supply 106 (see FIG. 2).

The inlet duct 1061 can be at least partially inserted into the front plate 102 or can be connected to the front duct 1023 from the outside of the front plate 102. The inlet duct 1061 can be formed integrally with the front duct 1023 or can be manufactured separately from and coupled to the front duct 1023.

The air supply 106 can be disposed on the base 105 and can have a shape extending along the front and rear direction. For example, the air supply 106 can extend from the front plate 102 to the rear plate 110 because of characteristics of the circulation flow channel.

The air supply 106 can be located on the base 105 close to one side in the lateral direction of the cabinet 100. For example, the air supply 106 can be disposed adjacent to the first side plate 109 positioned on one side in the lateral direction of the cabinet 100. The air supply 106 can be in close contact with the first side plate 109.

In some implementations, as the air supply 106 is disposed close to one side in the lateral direction, even without increasing an overall height of the cabinet 100, structural interference with the bottom of the drum 200 can be avoided and the space inside the cabinet 100 can be effectively utilized.

The air introduced into the air supply 106 can flow from the front portion to the rear portion of the cabinet 100 along the extension direction of the air supply 106. For example, the air of the air supply 106 can flow from the front plate 102 to the rear plate 110, and can flow from the front duct 1023 toward the air flow portion 130.

The air supply 106 can have the outlet duct 1064 at a rear portion thereof facing the rear plate 110, and the outlet duct 1064 can be connected to the blower 107. A shape and a form of connection with the blower 107 of the outlet duct 1064 can vary.

The blower 107 can include a blower fan housing in which the blower fan 1071 is embedded, and the blower motor 1073 connected to the blower fan 1071 to provide the rotational force. The blower fan housing can be formed in various shapes, and the blower motor 1073 can be coupled to the blower fan housing and positioned at the rear of the blower fan housing.

A motor shaft of the blower motor 1073 can be parallel to the rotation shaft of the blower fan 1071, and can be located at a center of a cross-section of an air flow channel defined inside the air supply 106. The blower fan 1071 can form a flow in which the air of the laundry treating apparatus 10 is circulated.

In some implementations, the blower motor 1073 can be inserted into the rear plate 110 from the front of the rear plate 110 and fixed inside the rear plate 110. Accordingly, a plurality of power generators for generating the rotation force, like the driver 400 and the blower motor 1073, can be disposed on the rear plate 110. For example, in some implementations, the driver 400 and the blower motor 1073 can be disposed on the rear plate 110 together.

In some implementations, the blower 107 can be connected to the outlet duct 1064 from one side, and connected to the fan duct 108 from the other side. The blower 107 can flow the air of the air supply 106 into the fan duct 108 through the blower fan 1071.

The fan duct 108 can connect the blower 107 and the air flow portion 130 to each other. The air flow portion 130 can be disposed at the rear of the drum rear surface 210 and the blower 107 can be located below the drum 200, so that the fan duct 108 can extend upwards from the blower 107 and be connected to the air flow portion 130.

In some implementations, the rear plate 110 can include the inlet extension 138 extending from the air flow portion 130, and the inlet extension 138 can include an extension space 1381 extending from a flow space 135 defined inside the air flow portion 130.

The inlet extension 138 can extend on the rear plate 110 from the air flow portion 130 toward the air supply 106. The inlet extension 138 can be opened frontwards, so that at least a portion of the blower 107 can be inserted into the extension space 1381.

For example, at least a portion of the fan duct 108 and at least a portion of the blower 107 can be located in the extension space 1381. In some implementations, at least a portion of the fan duct 108 and the blower motor 1073 can be inserted into the extension space 1381.

In some implementations, the air flow portion 130 can include the flow space 135 opened frontwards as depicted in FIG. 4. The driver mounting portion 120 can be disposed at a central portion of the air flow portion 130 formed in an annular shape.

In some implementations, the annular shape may mean a continuously extending closed curve, and a shape of a ring forming a closed cross-section inwardly. In some implementations, the annular shape may be a shape corresponding to a circumference of a polygon as well as a circle.

The driver mounting portion 120 can be penetrated by the driver 400 coupled thereto from the rear. The driver 400 can include the driving shaft 430 and a bearing extension 440 surrounding the driving shaft 430, and the driving shaft 430 and the bearing extension 440 together can extend through the driver mounting portion 120.

In some implementations, the heat pump can be disposed on the base 105. The heat pump can include a plurality of heat exchangers and a compressor 1066, so that a fluid compressed through the compressor 1066 passes through the plurality of heat exchangers to exchange heat with the outside.

Specifically, the heat pump can include a first heat exchanger 1062, a second heat exchanger 1063, and the compressor 1066 (see FIG. 5). The heat pump can contain the fluid circulating in the first heat exchanger 1062, the second heat exchanger 1063, and the compressor 1066.

FIG. 5 is a diagram illustrating the first heat exchanger 1062 and the second heat exchanger 1063 of the heat pump embedded in the air supply 106. FIG. 4 shows the compressor 1066 located outside the air supply 106.

The first heat exchanger 1062 can correspond to an evaporator in which the fluid absorbs heat from the outside, and the second heat exchanger 1063 can correspond to a condenser in which the fluid discharges heat to the outside.

The first heat exchanger 1062 and the second heat exchanger 1063 can be disposed on a flow channel along which the air flows in the air supply 106 to dehumidify and heat the air. The first heat exchanger 1062 can condense the moisture present in the air by cooling the air and remove the condensed moisture from the air, and the second heat exchanger 1063 can heat the air by providing the air with the heat released from the fluid.

In some implementations, the first heat exchanger 1062 on the air flow channel of the air supply 106 can be located upstream of the second heat exchanger 1063. For example, the first heat exchanger 1062 can be positioned in front of the second heat exchanger 1063, and the first heat exchanger 1062 can be positioned to face the inlet duct 1061.

The air introduced through the inlet duct 1061 can flow to pass through the first heat exchanger 1062. The air discharged from the interior of the drum 200 and introduced through the inlet duct 1061 can contain a large amount of moisture evaporated from the laundry.

The air introduced through the inlet duct 1061 can pass through the first heat exchanger 1062, and water vapor in the air deprived of heat by the first heat exchanger 1062 can be condensed in the first heat exchanger 1062 and changed to a form of water droplets and can be removed from the air.

The air supply 106 can deliver condensed water condensed in the first heat exchanger 1062 to a water collector 1065 disposed outside the air supply 106. For example, the water collector 1065 can store the condensed water generated in the first heat exchanger 1062 of the air supply 106.

In some implementations, the second heat exchanger 1063 can be located downstream of the first heat exchanger 1062 in the air supply 106. For example, the second heat exchanger 1063 can be located at the rear of the first heat exchanger 1062, and can be disposed to face the blower 107 or the outlet duct 1064.

The second heat exchanger 1063 can correspond to the condenser from which the heat of the fluid is discharged to the outside, and the air passing through the second heat exchanger 1063 can be heated by the second heat exchanger 1063 and flow to the blower 107.

In some implementations, as the second heat exchanger 1063 is located downstream of the first heat exchanger 1062, the air cooled and dehumidified by the first heat exchanger 1062 can be discharged from the air supply 106 in a state of being heated again through the second heat exchanger 1063.

FIG. 5 shows the blower fan 1071 of the blower 107 for discharging the air that has passed through the second heat exchanger 1063 to the outside, and shows the blower motor 1073 connected to the blower fan 1071 from the rear of the blower fan 1071. At least a portion of each of the blower fan 1071 and the blower motor 1073 can be disposed within the extension space 1381 of the inlet extension 138 described above.

Referring back to FIG. 4, the water collector 1065 in which the condensed water removed from the air through the first heat exchanger 1062 is stored according to an embodiment of the present disclosure is shown. As described above, the air supply 106 can be located on one side in the lateral direction of the base 105, and the water collector 1065 and the compressor 1066 can be disposed on the other side in the lateral direction of the base 105.

In some implementations, as the driver 400 for rotating the drum 200 is placed on the rear plate 110, compared to a case in which the driver 400 is disposed on the base 105, a space on the base 105 can be effectively secured, and a size and a capacity of the water collector 1065 can be effectively increased.

In some implementations, the compressor 1066 can be located at the rear of the water collector 1065. Accordingly, it is possible to minimize transmission of noise and vibration generated by an operation of the compressor 1066 to the user who uses the laundry treating apparatus 10 in front of the laundry treating apparatus 10.

Figure 6:
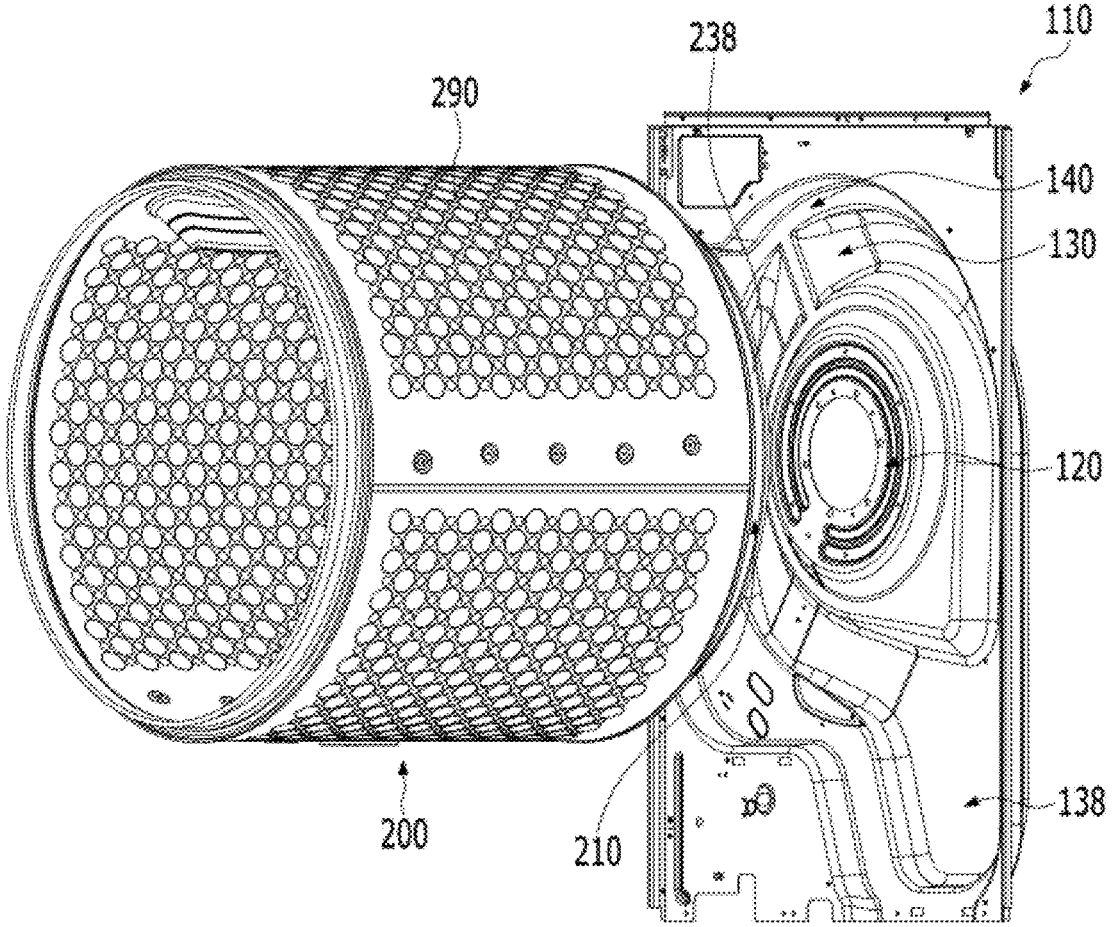
FIG. 6 is a diagram illustrating an exploded view of an example of a drum and a rear plate.
Figure 7:
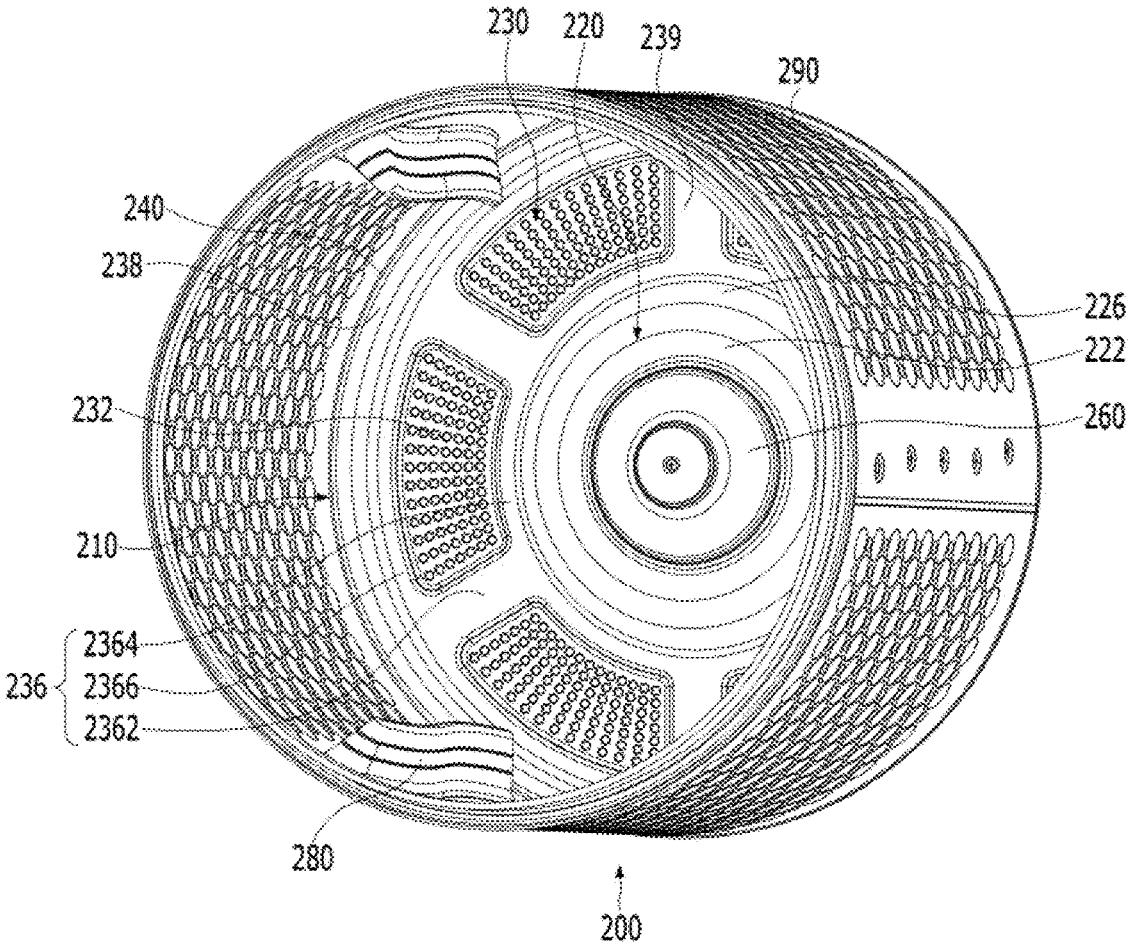
FIG. 7 is a diagram illustrating a drum in an exemplary laundry treating apparatus.

In some implementations, the drum 200 positioned in front of the rear plate 110 as depicted in FIG. 6, and FIG. 7 is a diagram illustrating a view of an interior of the drum 200 from the front.

In some implementations, the drum 200 can be located in front of the rear plate 110, and the air discharged from the air flow portion 130 of the rear plate 110 can pass through the drum rear surface 210 and be provided into the drum 200, as depicted in FIG. 6.

The drum 200 can have the drum inlet defined in the front surface thereof, and include an inlet circumference surrounding the drum inlet, and the inlet circumference can be supported by the front plate 102.

A drum circumferential surface 290 surrounding an inner space of the drum 200 can be disposed at the rear of the inlet circumference. The drum circumferential surface 290 can be formed in a cylindrical shape extending along the circumferential direction of the drum 200, and have a front end coupled to the inlet circumference, or have the front end integrally formed with the inlet circumference.

In the inner space of the drum 200 surrounded by the drum circumferential surface 290, the laundry input through the laundry inlet 1021 of the front plate 102 can be accommodated.

In some implementations, the drum rear surface 210 can be disposed at the rear of the drum circumferential surface 290. The drum rear surface 210 can be integrally formed with the drum circumferential surface 290 or manufactured separately and coupled to the drum circumferential surface 290.

The drum rear surface 210 can be constructed to shield or cover the space inside the drum 200 from the rear. The drum rear surface 210 can include the air passage 230 through which the air flowing out from the air flow portion 130 and toward the interior of the drum 200 passes, and can include the driver connection portion 220 connected to the driver 400.

In some implementations, a laundry lifter 280 for churning or lifting the laundry can be disposed inside the drum 200, as depicted in FIG. 7. The laundry lifter 280 can be disposed on an inner surface of the drum circumferential surface 290 facing toward the inside of the drum 200.

The drum 200 can extend along the front and rear direction of the cabinet 100, and the laundry lifter 280 can extend approximately parallel to the extended longitudinal direction of the drum 200. The laundry lifter 280 can include a plurality of laundry lifters disposed spaced apart from each other along the circumferential direction of the drum 200.

In some implementations, when the drum 200 rotates, an amount of movement of the laundry accommodated in the drum 200 can be increased by the laundry lifter 280, and a drying efficiency of the laundry can be effectively improved.

The drum circumferential surface 290 can have a convex portion and/or a concave portion to increase friction with the laundry. The convex portion or the concave portion can include a plurality of convex portions or concave portions and can be entirely distributed on the drum circumferential surface 290.

The air passage 230 can be formed in an annular shape and be positioned between the circumference connecting portion 240 and the driver connection portion 220 of the drum rear surface 210. The air passage 230 can include a plurality of ventilation holes 234, and have a ventilation portion 232 corresponding to a region including the ventilation holes 234. The plurality of ventilation portions 232 can be spaced apart from each other in a circumferential direction of the drum rear surface 210.

The drum rear surface 210 can have a reinforcing rib 236 for securing rigidity of the air passage 230 in which the ventilation portion 232 is formed. The reinforcing rib 236 can be formed in a protruding shape when viewed from the front, and can include a rear surface reinforcing rib 2362, an inner reinforcing rib 2364, and an outer reinforcing rib 2366.

The rear surface reinforcing rib 2362 can be disposed between adjacent two of the plurality of ventilation portions 232 and can protrude in a radial direction of the drum rear surface 210. The inner reinforcing rib 2364 can be located between the ventilation portion 232 and the rear surface central portion. The outer reinforcing rib 2366 can be positioned between the ventilation portion 232 and the circumference connecting portion 240 of the drum rear surface 210.

The inner reinforcing rib 2364 can be formed in an annular shape and can extend along the circumference of the driver connection portion 220 or an inner circumference of the air passage 230 facing toward the driver connection portion 220. The outer reinforcing rib 2366 can be formed in an annular shape and extend along the circumference connecting portion 240 or an outer circumference of the air passage 230 facing toward the circumference connecting portion 240.

In some implementations, the air passage 230 can be formed in a rearwardly recessed shape when viewed from the interior of the drum 200, and the driver connection portion 220 can be formed in a shape protruding toward the interior of the drum 200.

The driver connection portion 220 can be at least partially penetrated by the driving shaft 430 and be connected to the driving shaft 430. A shaft cap 260 for shielding or covering the driving shaft 430 from the interior of the drum 200 can be disposed in front of the driver connection portion 220.

The high-temperature air supplied from the air flow portion 130 can exist inside the drum 200, and the transfer of the heat inside the drum 200 to the driving shaft 430 and the driver 400 may be disadvantageous in terms of a thermal damage of components around the driver 400 and an operating efficiency of the driver 400.

In addition, the inner circumference of the air passage 230 is located outwardly of the driver 400 based on the radial direction of the drum 200, so that the air passing through the air passage 230 can flow in front of the driver 400 and inhibit the transfer of heat to the driver 400.

Thus, in some implementations, the driver connection portion 220 can be disposed in front of the driver 400 to overlap the driver 400 to suppress or block the heat inside the drum 200 from being transferred toward the driver 400.

Furthermore, the shaft cap 260 disposed inside the drum 200 in front of the driver connection portion 220 can shield or cover the driving shaft 430 from the interior of the drum 200, thereby suppressing or blocking the transfer of heat from the air to the driving shaft 430, and suppress or block the transfer of heat from the interior of the drum 200 to the driver 400 together with the driver connection portion 220.

Figure 8:
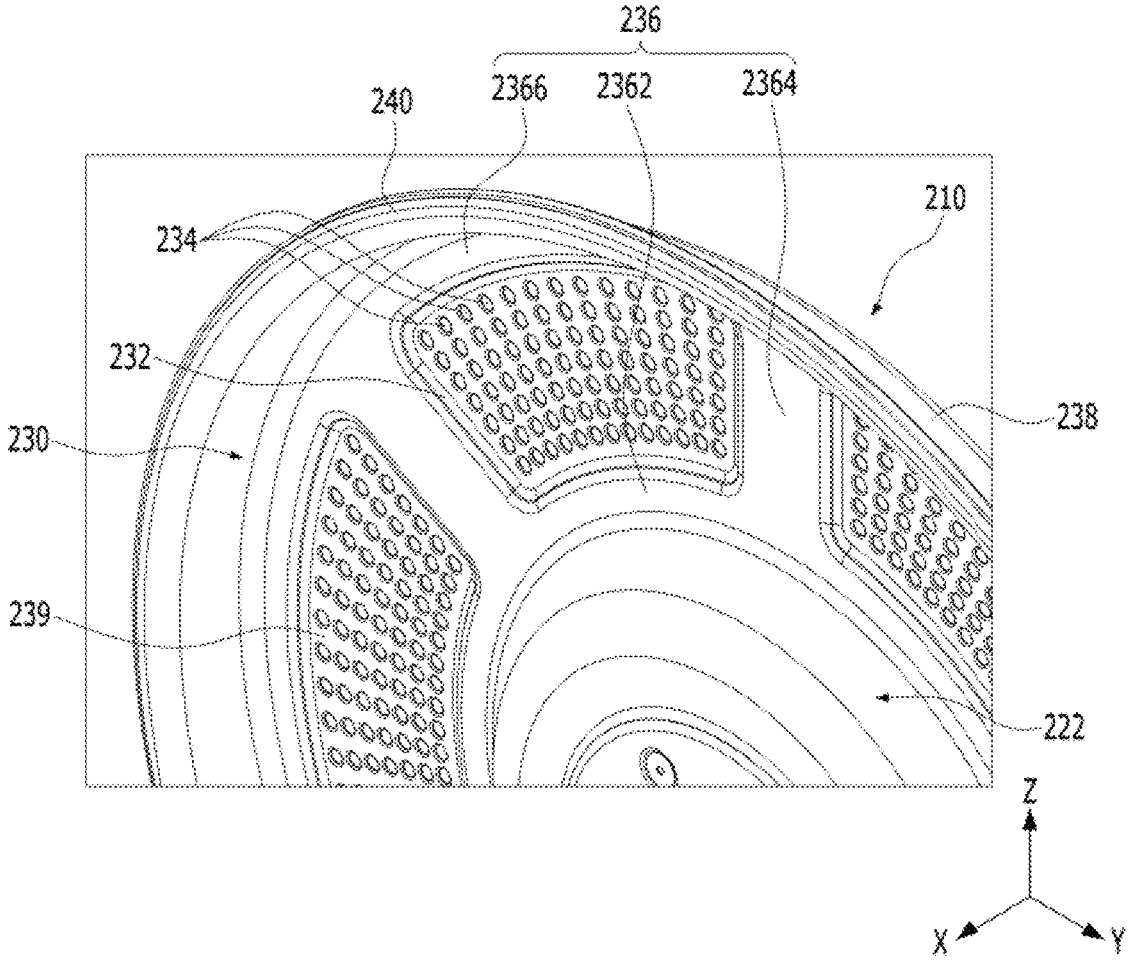
FIG. 8 is a diagram illustrating an air passage defined in a drum rear surface.
Figure 9:
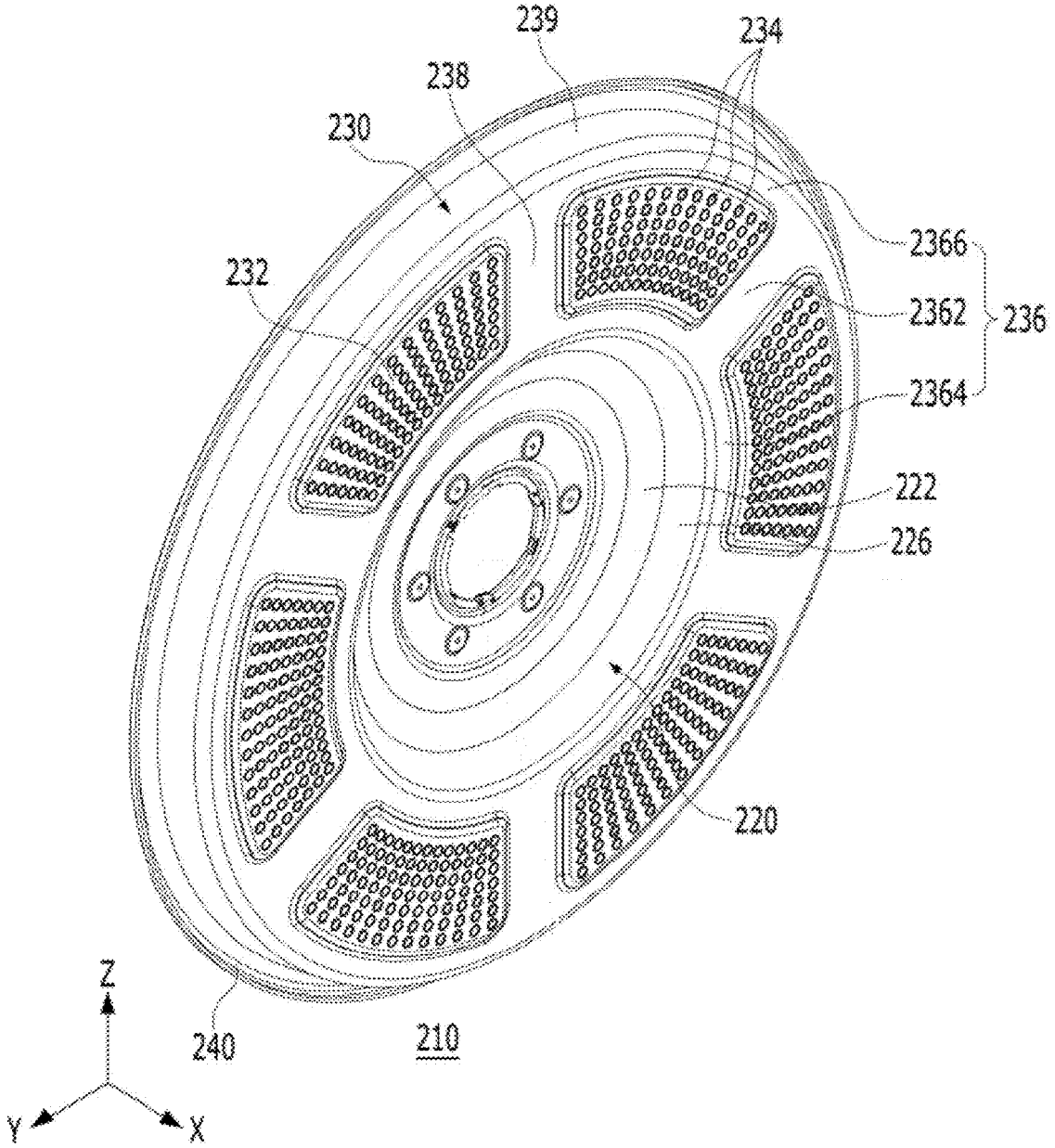
FIG. 9 is a diagram illustrating a view of a drum rear surface of an exemplary laundry treating apparatus from the rear.
Figure 10:
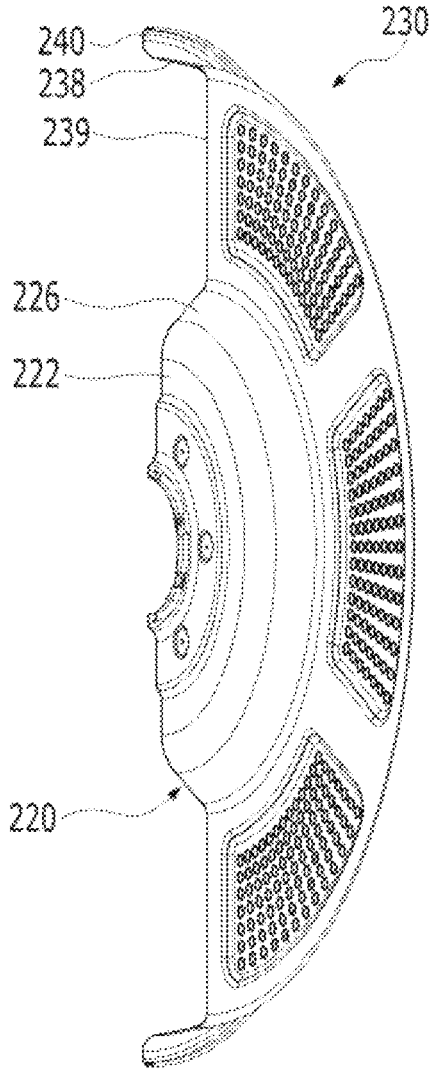
FIG. 10 is a diagram illustrating a cross-section of a drum rear surface of an exemplary laundry treating apparatus.

FIG. 8 is a diagram illustrating the air passage 230, FIG. 9 is a diagram illustrating a view of the drum rear surface 210 viewed from the rear, and FIG. 10 is a diagram illustrating a cross-section of the drum rear surface 210.

With reference to FIGS. 8 to 10, the drum rear surface 210 of the drum 200 will be described in detail as follows.

Referring to FIG. 8, in some implementations, the air passage 230 can protrude rearwards from the drum rear surface 210, the ventilation portion 232 can protrude rearwards from the air passage 230, and the driver connection portion 220 can protrude frontwards from the drum rear surface 210.

When viewing the drum rear surface 210 from the front, the air passage 230 can be defined in a form recessed rearwards from the front surface of the drum rear surface 210, and the ventilation portion 232 can be defined in a shape recessed rearwards from the front surface 131 of the air passage 230.

In some implementations, as the air passage 230 protrudes rearwards from the drum rear surface 210, the inner space of the drum 200 can be effectively increased, and a separation distance from the open front surface 131 of the air flow portion 130 can be effectively reduced, so that it may be advantageous to receive air from the air flow portion 130.

In some implementations, the ventilation portion 232 can protrude rearwards from the air passage 230 to be positioned closer to the open front surface 131 of the air flow portion 130, which may be advantageous in the introduction of the air from the air flow portion 130.

FIG. 9 shows that, in some implementations, the air passage 230 protrudes rearwards from the drum rear surface 210, the ventilation portion 232 protrudes rearwards from the air passage 230, and the driver connection portion 220 is recessed forwardly of the drum rear surface 210 to define a space therein.

In some implementations, as described above, the air passage 230 can include the reinforcing rib 236, and the reinforcing rib 236 can be disposed to surround the ventilation portion 232 to reinforce the rigidity of the air passage 230.

The reinforcing rib 236 can have a shape protruding frontwards in a relationship with the ventilation portion 232. For example, the reinforcing rib 236 can protrude frontwards in a relative relationship with the ventilation portion 232. The reinforcing rib 236 can be formed in a shape relatively protruding frontwards as the ventilation portion 232 is recessed rearwards from the air passage 230, or can be formed in a shape protruding frontwards from the air passage 230 separately from the ventilation portion 232.

In some implementations, as described above, the reinforcing rib 236 can include the inner reinforcing rib 2364, the rear surface reinforcing rib 2362, and the outer reinforcing rib 2366. Each of the plurality of ventilation portions 232 defined in the air passage 230 can be surrounded by inner reinforcing ribs 2364, the rear surface reinforcing ribs 2362, and the outer reinforcing ribs 2366.

FIG. 8 shows that the inner reinforcing rib 2364, the rear surface reinforcing rib 2362, and the outer reinforcing rib 2366 are connected to each other to surround the ventilation portion 232. However, the shape of the reinforcing rib 236 may not be necessarily limited thereto, and a protrusion height, an arrangement, and a connection relationship may vary as needed.

In one example, the structure of the drum rear surface 210 will be described in detail with reference to FIG. 10 as follows.

As described above, the drum rear surface 210 can include the circumference connecting portion 240 connected to the drum circumferential surface 290, and the air passage 230 can extend rearwards from the circumference connecting portion 240. That is, the air passage 230 can be located at the rear of the circumference connecting portion 240.

The air passage 230 can protrude rearwards from the circumference connecting portion 240. The air passage 230 can include a passage outer circumferential surface 238 extending rearwards from the circumference connecting portion 240 and extending along a circumferential direction of the drum 200, and can include an air passage surface 239 connected to the passage outer circumferential surface 238 from the rear.

The passage outer circumferential surface 238 can extend from the circumference connecting portion 240 toward the rear plate 110, and at least a portion thereof can be inserted into the rear plate 110. At least a portion of the air passage surface 239 can face the open front surface 131 of the air flow portion 130 from the front, and the air can be transferred from the air flow portion 130.

The air passage surface 239 can be located at the rear of the circumferential surface of the drum 200 to shield or cover the open front surface 131 of the air flow portion 130. The passage outer circumferential surface 238 and the air passage surface 239 can extend from the circumference connecting portion 240 to be integrally formed together as one body.

The air passage 230 can be defined as a portion of the drum rear surface 210 is bent or curved rearwards. For example, the air passage 230 can be defined by molding the drum rear surface 210 such that a circumference thereof protrudes rearwards through a pressing method or the like.

In some implementations, the air passage 230 is defined as a portion of the drum rear surface 210, which is advantageous in terms of a manufacturing process because the air passage 230 is not separately manufactured, and is advantageous in terms of airtightness because there is no coupling line through which the air leaks from the air passage 230.

In some implementations, the ventilation portion 232 can protrude rearwards from the air passage surface 239 when viewed from the rear, and can be recessed rearwards from the air passage surface 239 when viewed from the front. Because the ventilation portion 232 can be located closer to the flow recessed surface 132 than to the air passage surface 239, it may be advantageous for the air flowing through the flow space 135 of the air flow portion 130 to be introduced into the ventilation portion 232.

The ventilation portion 232 can be defined as at least a portion of the air passage surface 239 is bent or curved to protrude rearwards. That is, the ventilation portion 232 can be molded integrally with the air passage surface 239, which is advantageous in terms of a manufacturing process and is advantageous because there is no coupling line.

In some implementations, as described above, the air passage 230 can be formed in an annular shape and can protrude rearwards from the drum rear surface 210. Therefore, the air passage 230 can include an outer circumferential surface that protrude rearwards from the drum rear surface 210 and an inner circumferential surface.

The air passage 230 can have an outer circumference formed by the aforementioned passage outer circumferential surface 238, and can have an inner circumference formed by the connecting side surface 226 of the driver connection portion 220. That is, the inner circumference of the air passage surface 239 can be connected to the connecting side surface 226 of the driver connection portion 220.

The connecting side surface 226 of the driver connection portion 220 can extend frontwards from the inner circumference of the air passage surface 239, and can extend along the circumference of the driver connection portion 220. That is, the connecting side surface 226 can form the inner circumferential surface of the air passage 230, and can be formed in an annular shape to surround the space inside the driver connection portion 220.

The connecting front surface 222 can be connected to the connecting side surface 226 from the front. The connecting front surface 222 and the air passage surface 239 can be formed in a flat plate shape and can be disposed in parallel with each other. However, the specific shapes of the connecting front surface 222 and the air passage surface 239 may vary as needed.

The driver connection portion 220 can be formed to protrude frontwards from the air passage 230. The driver connection portion 220 can be formed as a center of the drum rear surface 210 is bent or curved. The driver connection portion 220, the air passage 230, and the circumference connecting portion 240 can be formed integrally as one body.

In some implementations, the driver connection portion 220 can extend frontwards from the air passage surface 239. Therefore, the connecting side surface 226 of the driver connection portion 220 can form the inner circumferential surface of the air passage 230, and the connecting front surface 222 of the driver connection portion 220 can be located relatively rearward than the circumference connecting portion 240.

In some implementations, as the air passage 230 protrudes rearwards from the drum rear surface 210, it is possible to effectively increase an internal capacity of the drum 200 in the limited inner space of the cabinet 100.

In addition, because the driver connection portion 220 protrudes frontwards, a length at which the driver 400 protrudes rearwards from the drum rear surface 210 can be effectively reduced, so that a compact coupling structure can be implemented.

Figure 11:
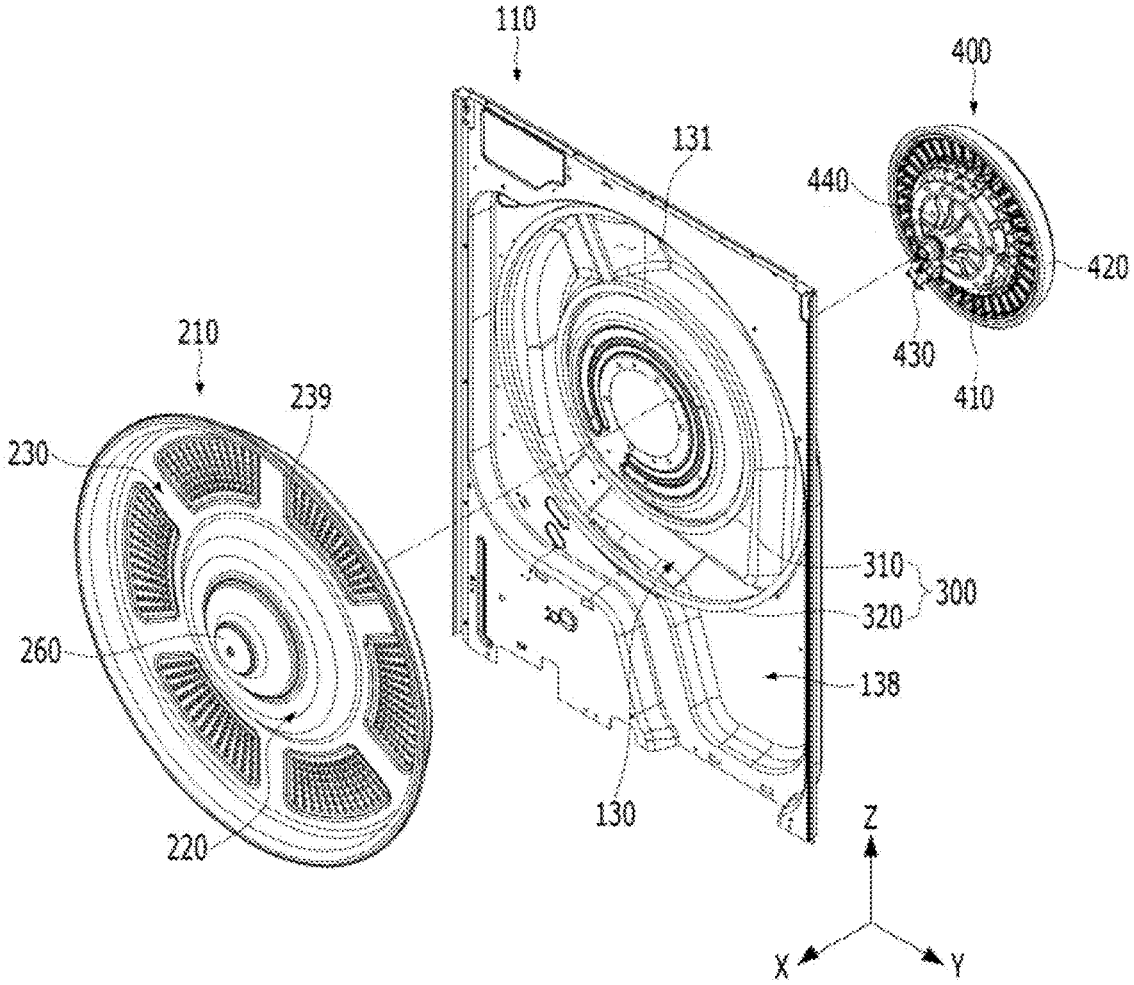
FIG. 11 is a diagram illustrating an example of arrangement relationship of a drum, a rear plate, and a driver.
Figure 12:
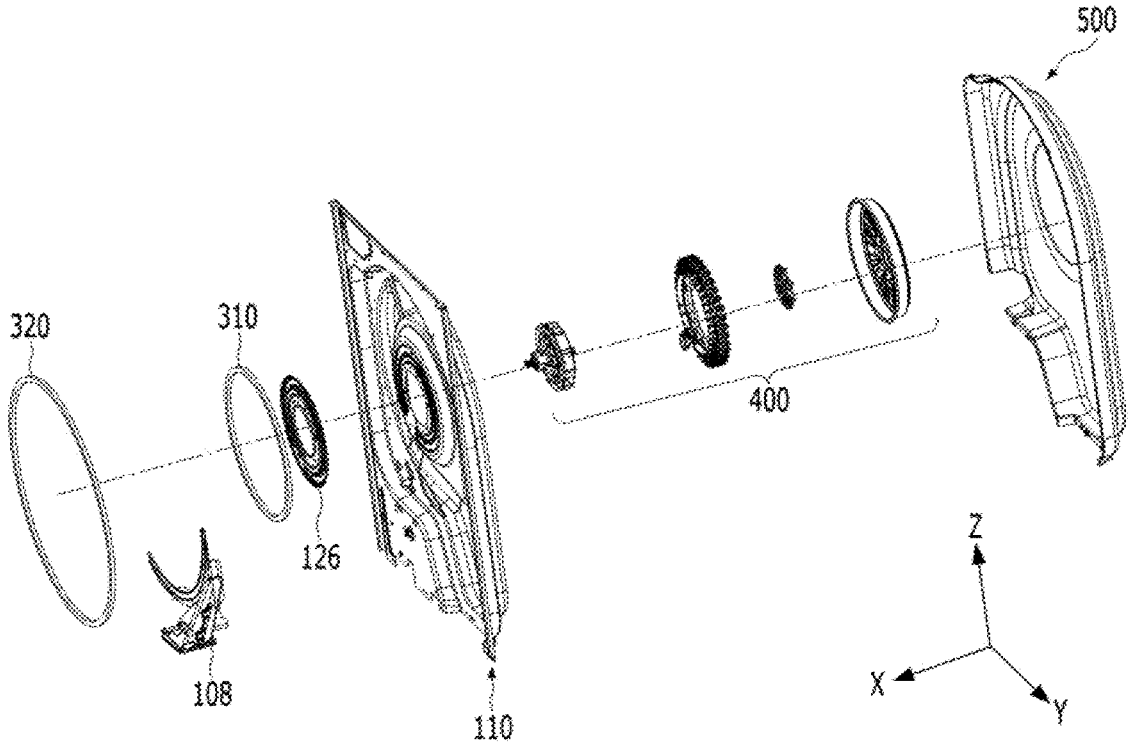
FIG. 12 is a diagram illustrating an exploded view of a rear portion of a cabinet in an exemplary laundry treating apparatus.

FIG. 11 is a diagram illustrating that the drum rear surface 210, the rear plate 110, and the driver 400 are aligned, and FIG. 12 is a diagram illustrating an exploded view of a plurality of components coupled to the rear plate 110.

Each component related to the rear plate 110 will be schematically described based on the rear plate 110 with reference to FIGS. 11 and 12.

As the drum rear surface 210 can be located in front of the rear plate 110, the open front surface 131 of the air flow portion can be shielded or covered from the front by the air passage 230 of the drum rear surface 210. In addition, in the rear plate 110, the driver 400 can be coupled to the driver mounting portion 120 from the rear, and the driving shaft 430 of the driver 400 can be positioned on the same line as the rotation shaft of the drum 200.

That is, in the rear plate 110, the driver 400 can be coupled to the driver mounting portion 120 from the rear, and the air flow portion 130 can be shielded or covered by the air passage 230 from the front. The driver 400 may can through the driver mounting portion 120 to be connected to the driver connection portion 220 of the drum rear surface 210.

In some implementations, the aforementioned rear sealer 300 can be disposed between the drum rear surface 210 and the rear plate 110, and the rear sealer 300 can include an inner sealer surrounding the inner circumference of the air flow portion 130 and an outer sealer 320 surrounding the outer circumference of the air flow portion 130.

The rear plate 110 can be connected to the air supply 106, and the air supply 106 can include a fan duct 108 for connecting the blower 107 and the air flow portion 130 to each other. The rear plate 110 can include an inlet extension 138 extending from the air flow portion 130, and the fan duct 108 can be connected to the air flow portion 130 through the inlet extension 138.

At the same time when the driver 400 is coupled to the driver mounting portion 120 of the rear plate 110 from the rear, the mounting bracket 126 can be coupled to the driver mounting portion 120 from the front.

The driver mounting portion 120 can include a mounting side surface 124 extending in an annular shape, and a mounting front surface 122 connected to the mounting side surface 124 from the front to shield the driver 400 from the front. A bracket seating portion 128 for coupling the mounting bracket 126 can be disposed on a front surface of the mounting front surface 122.

The mounting bracket 126 can be disposed at a front portion of the driver mounting portion 120 to form a coupling relationship with the driver 400 through the driver mounting portion 120, thereby effectively improving coupling stability of the driver 400 while increasing the rigidity of the driver mounting portion 120.

In some implementations, the rear plate 110 can be coupled with the rear cover 500 from the rear. Because the rear plate 110 can protrude rearwards from the rear surface of the air flow portion 130 and the driver 400 may be exposed rearwards, the rear cover 500 can be coupled to the rear plate 110 from the rear to shield or cover the air flow portion 130 and the driver 400 from the outside.

Figure 14:
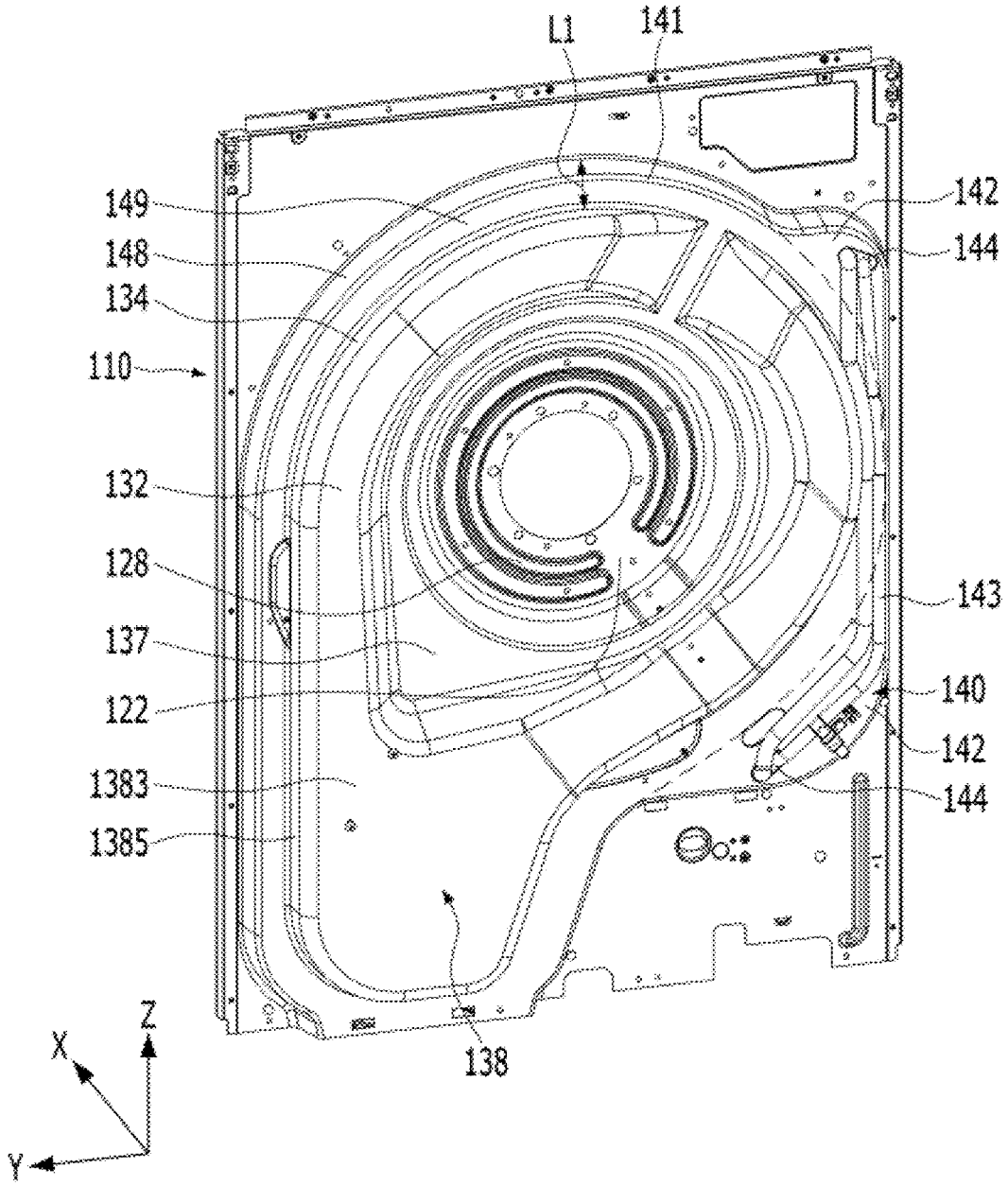
FIG. 14 is a diagram illustrating a view of a rear plate of an exemplary laundry treating apparatus from the rear.
Figure 15:
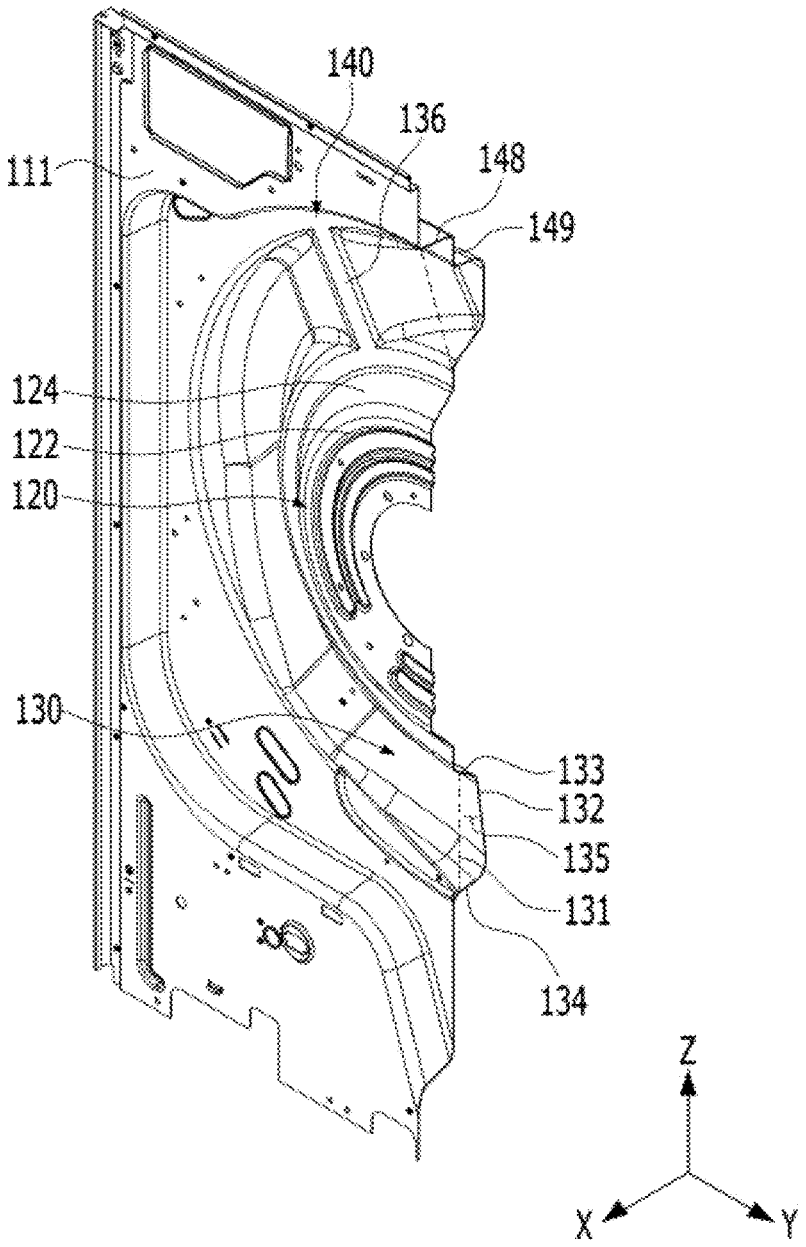
FIG. 15 is a diagram illustrating a cross-section of a rear plate in an exemplary laundry treating apparatus.

FIG. 13 is a diagram illustrating a front surface of the rear plate 110, FIG. 14 is a diagram illustrating a rear surface of the rear plate 110, and FIG. 15 is a diagram illustrating a cross-section of the rear plate 110 viewed from the lateral direction.

Hereinafter, the rear plate 110 will be described in detail with reference to FIGS. 13 to 15. Each component will be schematically summarized as follows prior to the description of the rear plate 110.

The drum 200 can be rotatably disposed inside the cabinet 100, can accommodate the laundry therein, and can have the drum rear surface 210 facing the rear plate 110. The driver 400 can be coupled to the rear plate 110 to be connected to the drum 200.

The rear plate 110 can include the driver mounting portion 120 and the air flow portion 130, the driver mounting portion 120 can be coupled to the driver 400, and the air flow portion 130 can surround the driver mounting portion 120 and can provide the air to the drum 200.

The drum rear surface 210 can include the driver connection portion 220 and the air passage 230. The driver connection portion 220 can face the driver mounting portion 120 and can be connected to the driver 400. The air passage 230 can surround the driver connection portion 220, and the air provided from the air flow portion 130 can pass through the air passage 230 and can be introduced into the drum 200.

In some implementations, the air flow portion 130 can protrude rearwards from the rear plate 110 to define therein the flow space 135 through which the air flows, and the flow space 135 can be opened frontwards and can be shielded or covered by the air passage 230.

Figure 16:
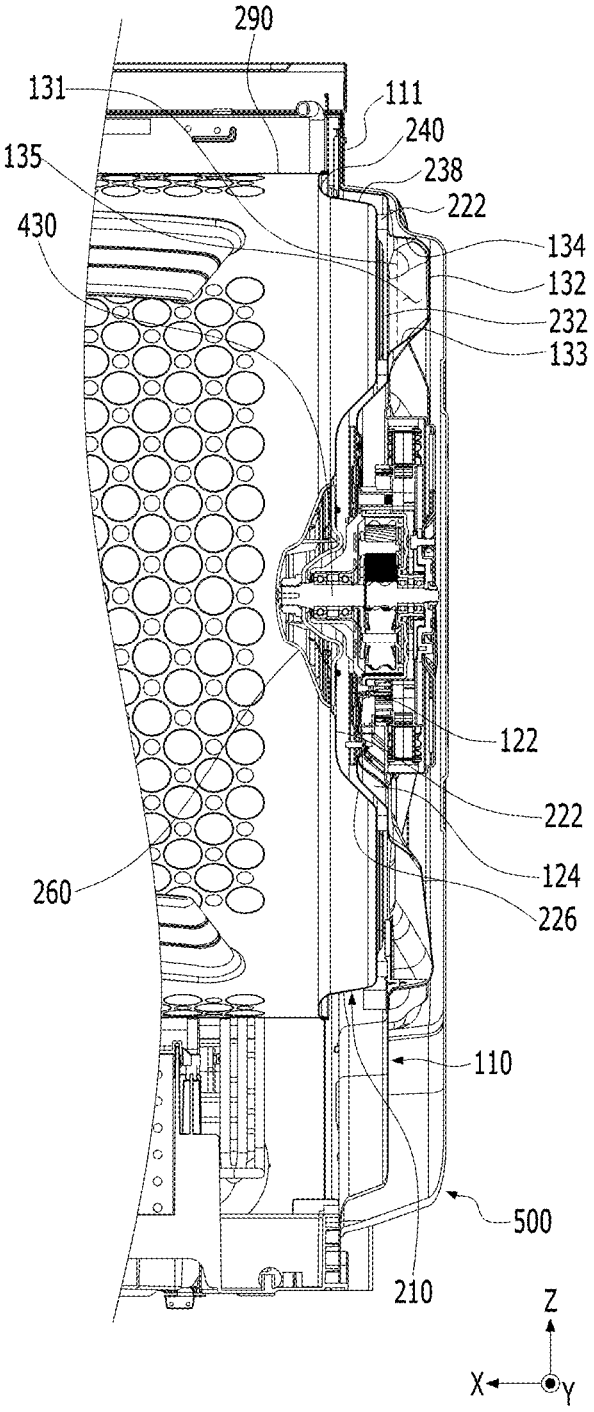
FIG. 16 is a diagram illustrating a cross-section of rear portion of a cabinet viewed from a lateral direction in an exemplary laundry treating apparatus.
Figure 17:
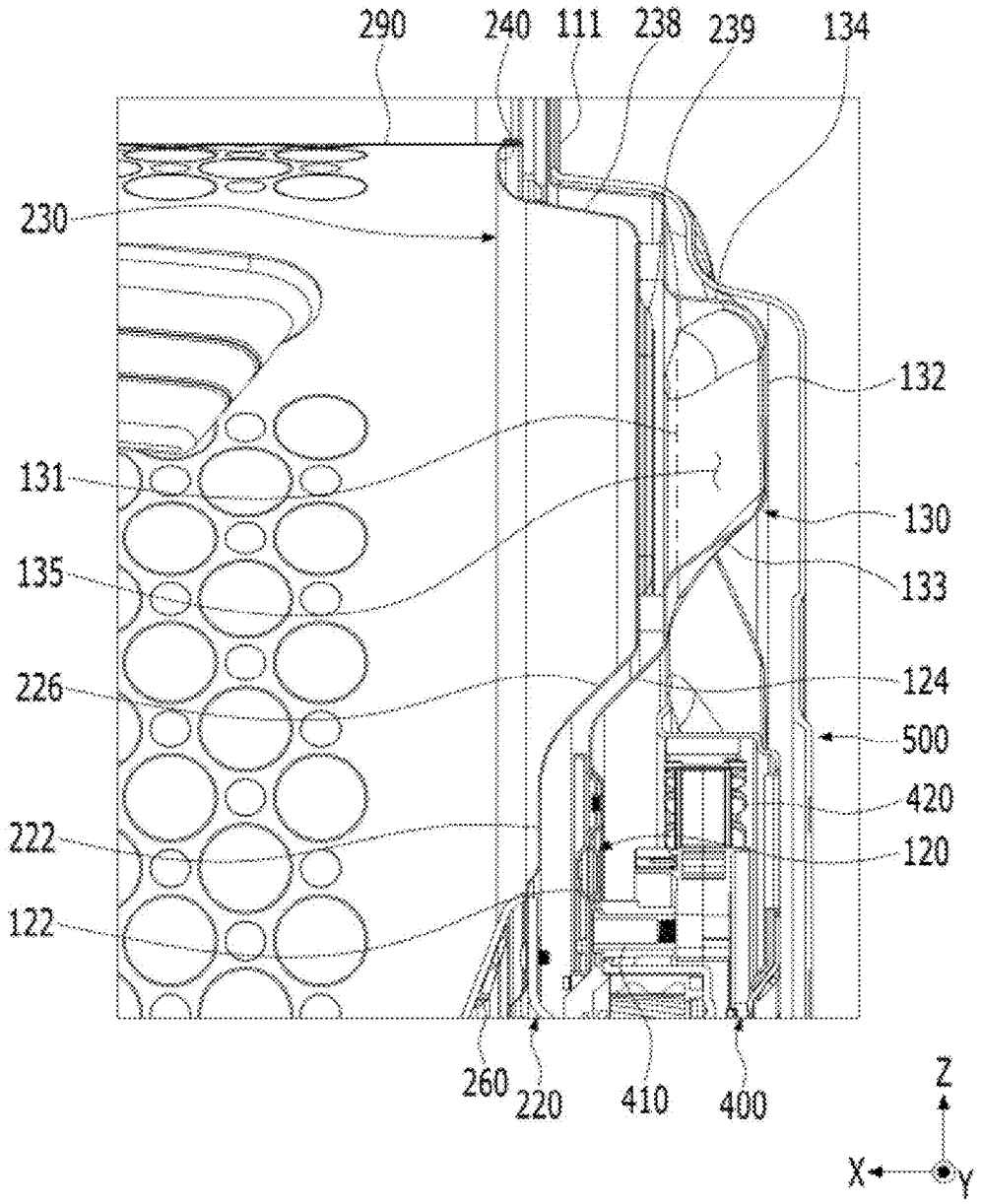
FIG. 17 is a diagram illustrating an enlarged view of an air passage and an air flow portion in FIG. 16.

FIG. 16 is a diagram illustrating a cross-section of the rear plate 110 and the drum 200 positioned in front of the rear plate 110, and FIG. 17 is a diagram illustrating an enlarged view of the air flow portion 130 in which the front surface 131 is shielded or covered by the air passage 230 in FIG. 16.

In some implementations, the air flow portion 130 can be defined in the rear plate 110 to discharge the air to the drum rear surface 210, and can protrude rearwards from the rear plate 110. The air flow portion 130 can have the flow space 135 defined therein through which the air flows, and the flow space 135 can be exposed frontwards through the open front surface 131.

The air flowing through the flow space 135 can be discharged frontwards through the open front surface 131 of the air flow portion 130. In the drum rear surface 210, the air can be transferred into the drum 200 through the aforementioned air passage 230.

In some implementations, in the rear plate 110, as the air flow portion 130 protrudes rearwards, the flow space 135 can be defined rearwardly of the rear plate 110. Therefore, it is possible to effectively secure a space from the drum rear surface 210 for increasing the capacity of the drum 200.

Further, in some implementations, as the air flow portion 130 is defined such that the front surface 131 is open, a flow resistance of the air flowing out from the flow space 135 toward the drum rear surface 210 can be effectively reduced and fluidity can be improved, so that the air can be effectively supplied into the drum 200.

For example, when the front surface 131 of the air flow portion 130 is formed as a grill surface or the like having a plurality of holes, the air in the flow space 135 may flow frontwards through the holes in the grill surface, but a flow resistance resulted from the grill may occur, and thus, a flow rate or a flow velocity of the air flowing toward the drum rear surface 210 may be reduced.

Furthermore, in order to form the grill surface, a punching process for defining the plurality of holes or a process for coupling the grill surface is involved, which is disadvantageous in manufacturing the rear plate 110.

However, in some implementations, as an entirety of the front surface 131 of the air flow portion 130 is formed in an open shape, the flow resistance of the air flowing out frontwards from the flow space 135 can be improved, and effective supply of the air toward the drum rear surface 210 may become possible.

Further, in some implementations, the open front surface 131 of the air flow portion 130 can be directly shielded or covered by the air passage 230 supplied with the air, so that the distance between the flow space 135 and the air passage 230 can be minimized, and an effective structure for the air transfer can be implemented.

In some implementations, the air flow portion 130 can be defined as the rear plate 110 is bent or curved. The air flow portion 130 can provide the air while directly facing the air passage 230 with the front surface 131 facing the air passage 230 being opened.

FIG. 13 depicts that a state in which the air flow portion 130 is defined as a portion of the rear plate 110 is bent or curved.

In some implementations, the air flow portion 130 may be integrally molded with the rear plate 110. For example, the air flow portion 130 can be defined as at least a portion of the rear plate 110 is bent or curved through the pressing method or the like.

The air flow portion 130 can be defined to protrude rearwards from the rear plate 110. Accordingly, the air flow portion 130 can be defined as the rear plate 110 is bent or curved such that a portion thereof protrudes rearwardly of the remaining portion.

The air flow portion 130 can be recessed rearwards when viewed from the front of the rear plate 110 to define the flow space 135 therein, and can protrude rearwards from the rear plate 110 when viewed from the rear of the rear plate 110.

In some implementations, as the air flow portion 130 is molded as a portion of the rear plate 110, a separate member for defining the air flow portion 130 is not coupled to the rear plate 110, which is advantageous in manufacturing.

Furthermore, because there is no coupling line with the rear plate 110 on the air flow portion 130, the leakage of the air flowing through the flow space 135 can be effectively blocked. In some implementations, the coupling line means a boundary region formed as different components are coupled to each other.

In some implementations, the driver 400 can be coupled to the driver mounting portion 120 from the rear of the driver mounting portion 120, and the air flow portion 130 can be defined in an annular shape to surround the driver 400.

FIG. 13 depicts the air flow portion 130 protruding rearwards from the rear plate 110 to surround the driver mounting portion 120, and FIG. 16 is a cross-sectional view of the driver 400 coupled to the driver mounting portion 120 from the rear of the driver mounting portion 120.

The driver 400 can be coupled to the driver mounting portion 120 at the rear of the rear plate 110. That is, the driver 400 can be coupled to the rear surface of the driver mounting portion 120. The rear surface of the driver mounting portion 120 can be forwardly concave to define a space therein, and the driver 400 can be inserted into the space and coupled to the driver mounting portion 120.

At least a portion of the driver 400 coupled to the driver mounting portion 120 from the rear may protrude rearwards, and may be exposed to external impact. In some implementations, as the air flow portion 130 protrudes rearwards from the rear plate 110 and surrounds the driver 400, it is possible to protect the driver 400 from external impact.

In some implementations, the rear plate 110 can include a rear protrusion 140 protruding rearwards to define a space therein, and the air flow portion 130 can protrude rearwards from the rear protrusion 140.

The air passage 230 can protrude rearwards from the drum rear surface 210 to be inserted into the rear protrusion 140 and can shield the open front surface 131 of the air flow portion 130.

FIGS. 13 to 17 show the rear protrusion 140 that protrudes rearwards from the rear plate 110, and FIGS. 16 and 17 show the air passage 230 inserted into the rear protrusion 140.

Specifically, the rear protrusion 140 can protrude rearwards from the rear plate 110, and can have a space defined therein forwardly. The rear protrusion 140 can be formed as a portion of the rear plate 110 is bent or curved.

The air flow portion 130 can protrude rearwards from the rear protrusion 140. Therefore, the rear plate 110 can have the front surface recessed rearwards by the rear protrusion 140 and the air flow portion 130 to define a space therein, and have the rear surface having a shape that protrudes rearwards in a multi-step form.

In some implementations, as described above, in the drum rear surface 210, the air passage 230 can protrude rearwards, and the air passage 230 can be inserted into the space defined by the rear protrusion 140 from the front of the rear protrusion 140. In addition, the air passage 230 can be inserted into the rear protrusion 140 to directly face the open front surface 131 of the air flow portion 130 and shield the front surface 131.

In some implementations, in the drum rear surface 210, the air passage 230 can protrude rearwards to effectively expand the space inside the drum 200, and the rear plate 110 can provide the space in which the air passage 230 is accommodated by forming the rear protrusion 140.

Accordingly, in some implementations, the space utilization can be improved because the air passage 230 protruding rearwards from the drum 200 can be accommodated inside the cabinet 100 without the entire rear plate 110 being further rearwardly separated from the drum 200.

Furthermore, the air passage 230 supplied with the air from the air flow portion 130 protrudes rearwards from the drum rear surface 210, and the air flow portion 130 protrudes rearwards from the rear protrusion 140, so that the air passage 230 can be at least partially accommodated in the rear protrusion 140, and at the same time, can effectively shield or cover the open front surface 131 of the air flow portion 130 and receive the air.

In some implementations, the rear protrusion 140 can include a rear circumference region 141 expanded from the air flow portion 130 radially outward of the air flow portion 130 by a reference distance L1, and an expanded circumference region 142 that is expanded from the air flow portion 130 radially outward of the air flow portion 130 by a distance greater than the reference distance L1 (see FIG. 14).

In addition, the expanded circumference region 142 can include an extension hole 144 through which an extension member 143 withdrawn out from the interior of the cabinet 100 passes. FIG. 14 shows the expanded circumference region 142 of the rear protrusion 140.

As described above, in some implementations, as the rear protrusion 140 is formed on the rear plate 110, it is possible to effectively increase the space inside the cabinet 100 without increasing an overall volume of the cabinet 100.

The space defined inside the cabinet 100 by the rear protrusion 140 can accommodate the air passage 230 of the drum rear surface 210, and at the same time, further accommodate various components inside the cabinet 100, thereby improving the utilization of the space inside the cabinet 100.

In one example, because the air passage 230 accommodated inside the rear protrusion 140 rotates with the drum 200 as a portion of the drum rear surface 210, the rear outer circumferential surface 148 corresponding to the outer circumferential surface of the rear protrusion 140 needs to be spaced apart from the passage outer circumferential surface 238 of the air passage 230 by a certain distance along the circumferential direction of the drum 200.

However, in some implementations, to limit unnecessary increase in an area of the rear protrusion 140, the rear circumference region 141 of the rear protrusion 140 may expand from the air flow portion 130 or the air passage 230 radially outward of the air flow portion 130 by the reference distance L1, and the expanded circumference region 142 may expand from the air flow portion 130 or the air passage 230 radially outward of the air flow portion 130 by the distance equal to or greater than the reference distance L1, so that an additional space may be secured between the rear outer circumferential surface 148 and the passage outer circumferential surface 238.

The reference distance L1 may correspond to a separation distance at which the rear outer circumferential surface 148 and the like may not interfere with the rotating air passage 230, which may be variously determined in terms of design.

In some implementations, the expanded circumference region 142 can have various shapes and can be disposed at various positions. The specific shape and the position of the expanded circumference region 142 can be variously determined depending on the arrangement of the components inside the cabinet 100.

Referring to FIG. 14, in some implementations, the expanded circumference region 142 can be defined in a portion of the rear protrusion 140 or can include a plurality of expanded circumference regions. FIG. 14 shows a state in which a portion of the rear circumference region 141 facing the side plates 109 extends toward the side plate 109 to define the expanded circumference region 142.

In some implementations, the expanded circumference region 142 can have the extension hole 144 through which the extension member 143 withdrawn out from the interior of the cabinet 100 passes. For example, in some implementations, the extension member 143 extending from the interior of the cabinet 100 can be withdrawn to the outside through the space defined by being spaced apart from the drum 200 by the expanded circumference region 142.

The extension member 143 may be of various types. For example, the extension member 143 can correspond to a drain pipe or the like extending outwardly from the water collector 1065 described above. After the extension member 143 is withdrawn to the outside through the expanded circumference region 142 from the inner lower portion of the cabinet 100, the extension member 143 can extend along the rear surface of the rear plate 110 and can be retracted into the inner upper portion of the cabinet 100 again through the expanded circumference region 142.

In some implementations, as the extension member 143 can extend outside the cabinet 100 to connect the different components inside the cabinet 100 to each other, it is possible to effectively improve the capacity of the drum 200 while preventing structural interference between the drum 200 and the extension member 143.

Furthermore, in some implementations, by the expanded circumference region 142, a space in which the extension member 143 extends while being spaced apart from the drum 200 inside the cabinet 100 may be effectively secured, and the rear circumference region 141 and the expanded circumference region 142 are separately defined in the rear protrusion 140, so that unnecessary increase in the area of the rear protrusion 140 can be limited.

In some implementations, the rear plate 110 can include the rear reference surface 111 positioned at the rear of the drum 200, the rear protrusion 140 can protrude rearwards from the rear reference surface 111, the air flow portion 130 can protrude rearwards from the rear protrusion 140, and the driver mounting portion 120 can protrude frontwards from the rear protrusion 140.

Referring to FIG. 15, in some implementations, a portion of the rear plate 110 excluding the rear protrusion 140 can correspond to the rear reference surface 111. That is, the rear reference surface 111 may be a portion that does not protrude from the rear plate by the rear protrusion 140. The rear reference surface 111 may be formed in an approximately flat plate shape.

In the rear plate 110, the rear reference surface 111 may be a reference for identifying an extent to which the rear protrusion 140 and the air flow portion 130 protrude rearwards. That is, in some implementations, at least a portion of the rear protrusion 140 and the air flow portion 130 can be located at the rear of the rear reference surface 111.

The rear protrusion 140 can protrude rearwards from the rear reference surface 111 and can be formed to be stepped from the rear reference surface 111. The air flow portion 130 can protrude rearwards from the rear protrusion 140 and can be formed to be stepped from the rear protrusion 140.

Specifically, the rear protrusion 140 can include the rear outer circumferential surface 148 extending rearwards from the rear reference surface 111 and extending along the circumference of the rear protrusion 140, and can include the rearwardly protruding surface 149 that is connected to the rear outer circumferential surface 148 to shield or cover the interior of the cabinet 100.

The rearwardly protruding surface 149 can be in a plate shape approximately parallel to the rear reference surface 111, and the rear outer circumferential surface 148 can surround the rearwardly protruding surface 149 and can be connected to a circumference of the rearwardly protruding surface 149.

The air flow portion 130 can include a flow outer circumferential surface 134 extending rearwards from the rearwardly protruding surface 149 and surrounding an outer circumference of the flow space 135, a flow inner circumferential surface 133 extending rearwards from the rearwardly protruding surface 149 and surrounding an inner circumference of the flow space 135, and a flow recessed surface 132 positioned at the rear of the rearwardly protruding surface 149 to shield the flow space 135 from the rear and connected to the flow outer circumferential surface 134 and the flow inner circumferential surface 133.

The air flow portion 130 can be formed in an annular shape, the flow inner circumferential surface 133 can be formed to surround the driver mounting portion 120 and the driver 400, and the flow outer circumferential surface 134 can be formed to surround the flow inner circumferential surface 133 and the flow space 135.

Based on the radial direction of the air flow portion 130, the flow outer circumferential surface 134 can be located outward of the flow inner circumferential surface 133 and the flow space 135. The flow recessed surface 132 can be disposed in a space where the flow outer circumferential surface 134 and the flow inner circumferential surface 133 are spaced apart from each other. The flow recessed surface 132 can have an inner circumference connected to the flow inner circumferential surface 133 and an outer circumference connected to the flow outer circumferential surface 134.

The air flow portion 130 can be located in the rearwardly protruding surface 149, and the rear protrusion 140 can be located in the rear reference surface 111. That is, at least a portion of the circumference of the air flow portion 130 can be surrounded by the rear protrusion 140, and at least a portion of the circumference of the rear protrusion 140 can be surrounded by the rear reference surface 111.

The rearwardly protruding surface 149 can be located at the rear of the rear reference surface 111, and the flow recessed surface 132 can be located at the rear of the rearwardly protruding surface 149. In the rear plate 110, the rear reference surface 111, the rear protrusion 140, and the air flow portion 130 can be formed to be stepped from each other.

In some implementations, the rear plate 110 includes the rear protrusion 140 protruding rearwards within the rear reference surface 111, and includes the air flow portion 130 protruding rearwards within the rear protrusion 140, thereby effectively expanding the inner space of the cabinet 100 while minimizing an unnecessarily outwardly protruding portion.

Figure 18:
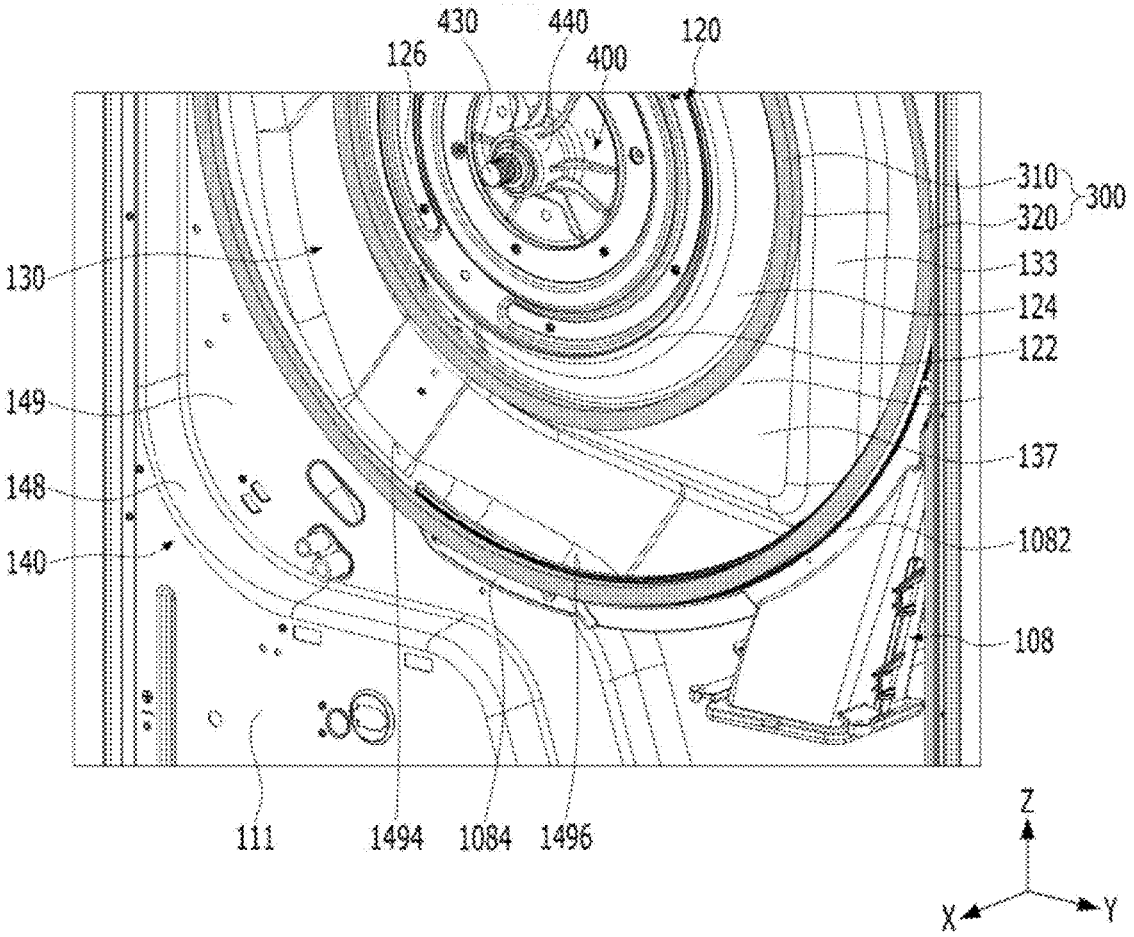
FIG. 18 is a diagram illustrating an example of an air flow portion and an inlet extension of a rear plate.
Figure 19:
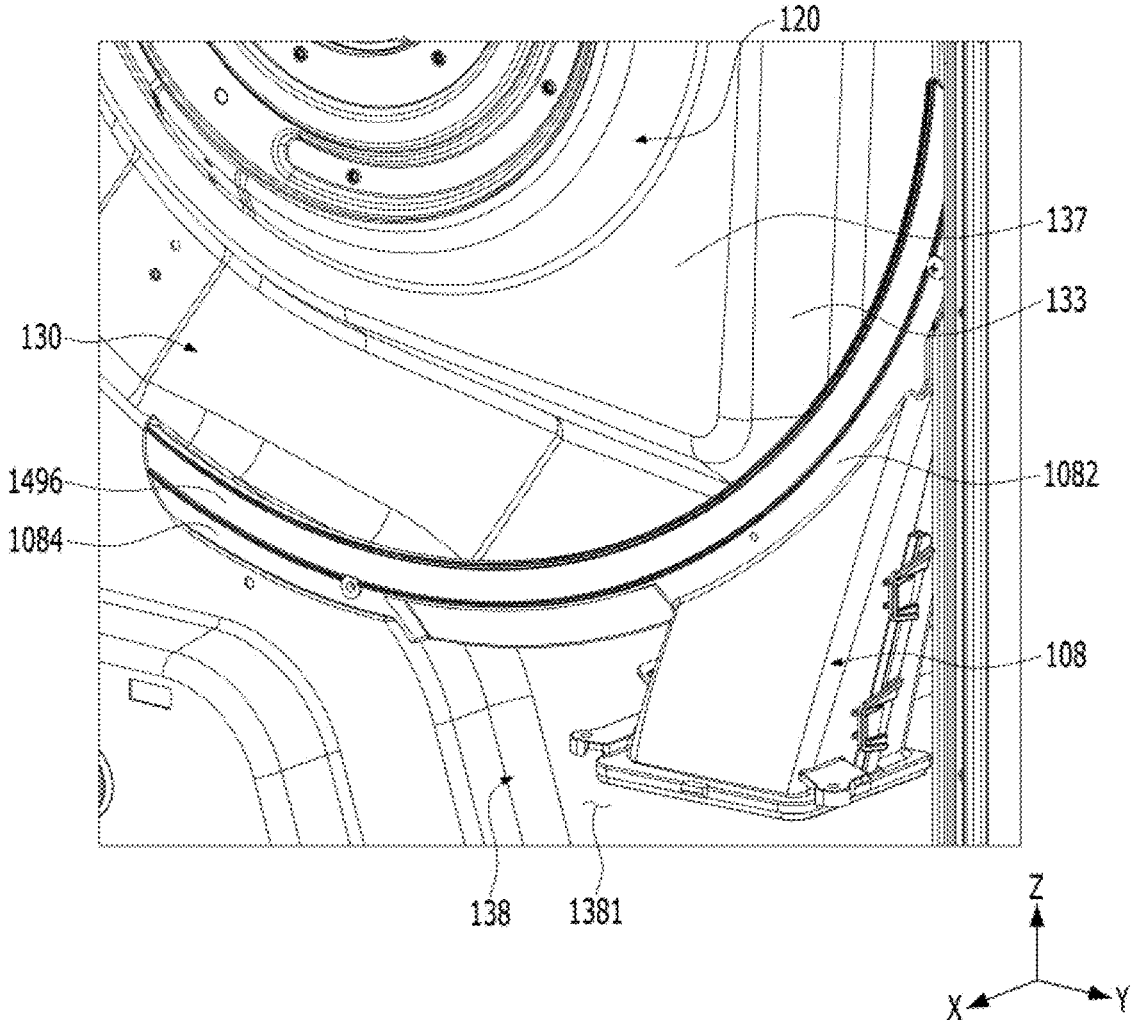
FIG. 19 is a diagram illustrating an example of a fan duct coupled to a rear plate.
Figure 20:
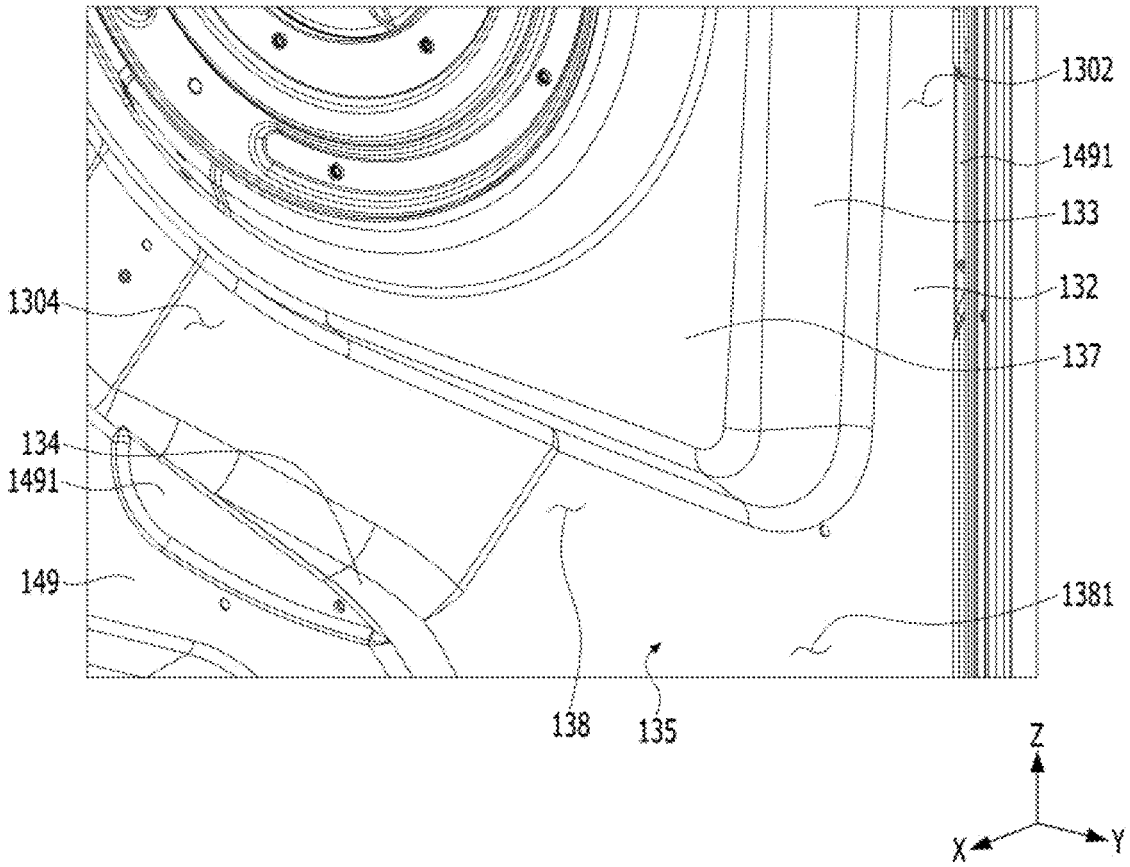
FIG. 20 is a diagram illustrating a rear plate from which a fan duct is removed in FIG. 19.

FIG. 18 is a diagram illustrating the inlet extension 138 extending from the air flow portion 130 and coupled with the fan duct 108, FIG. 19 is a diagram illustrating the fan duct 108 inserted into the flow space 135, and FIG. 20 is a diagram illustrating the flow space 135 of the inlet extension 138 from which the fan duct 108 is removed in FIG. 19.

Referring to FIGS. 18 to 20, in some implementations, the inlet extension 138 can include an extension space 1381 that extends from the flow space 135 toward the air supply 106 and opens frontwards.

The air supply 106 can include the fan duct 108 described above, and at least a portion of the fan duct 108 can be inserted into the extension space 1381 to discharge the air into the flow space 135.

In addition, the fan duct 108 can include an air discharge portion 1082 inserted into the extension space 1381 to divide the flow space 135 and the extension space 1381 from each other and discharge the air into the flow space 135.

As described above, the inlet extension 138 can extend from the air flow portion 130 and be connected with the air supply 106. The inlet extension 138 can include the extension space 1381 extending from the flow space 135, and can have a front surface that is opened such that the fan duct 108 can be inserted thereinto from the front.

Figure 21:
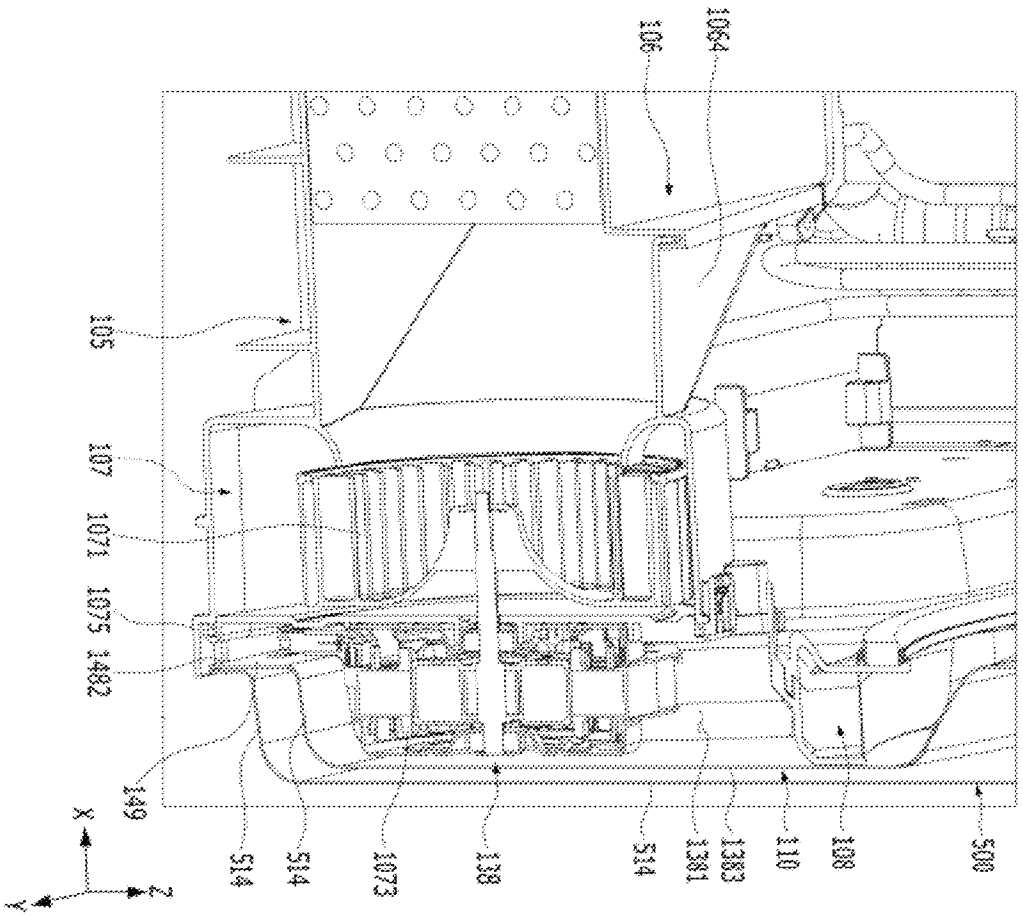
FIG. 21 is a diagram illustrating an example of a blower inserted into an inlet extension.

The inlet extension 138 can include an extended circumferential surface 1385 surrounding the extension space 1381, and can form an extended recessed surface 1383 for shielding or covering the extension space 1381 from the rear (see FIG. 21). The inlet extension 138 can be integrally formed with the air flow portion 130 to protrude rearwards from the rear reference surface 111 or the rear protrusion 140 of the rear plate 110.

The extended circumferential surface 1385 can protrude rearwards from the rearwardly protruding surface 149. The extension space 1381 can be connected to the flow space 135, and the extended circumferential surface 1385 can surround the extension space 1381 in the remaining region except for a connection region between the extension space 1381 and the flow space 135 (see FIG. 23).

That is, the flow outer circumferential surface 134 extending along the outer circumference of the flow space 135 can be formed in an annular shape opened by the extension space 1381, and an extended outer circumferential surface can connect one end and the other end of the flow outer circumferential surface 134 to each other while surrounding the extension space 1381.

The flow outer circumferential surface 134 and the extended outer circumferential surface can together form one closed cross-section. The flow outer circumferential surface 134 and the outer circumferential surface can together surround the outer circumferences of the flow space 135 and the extension space 1381, and the extended outer circumferential surface can be formed as a portion of the flow outer circumferential surface 134.

The extended recessed surface 1383 can be positioned at the rear of the rearwardly protruding surface 149 and may extend from the flow recessed surface 132. That is, the extended recessed surface 1383 can form a single surface positioned at the rear of the rearwardly protruding surface 149 together with the flow recessed surface 132.

In some implementations, the fan duct 108 can extend from the air supply 106 as described above, can have an end facing the flow space 135 or the extension space 1381 inserted into the extension space 1381, and can be coupled to the rear plate 110.

The fan duct 108 can be inserted into the extension space 1381 to discharge the air toward the flow space 135. The air discharge direction B of the fan duct 108 can be parallel to the flow recessed surface 132, and can be parallel to the radial or tangential direction of the air flow portion 130 (see FIG. 23).

In some implementations, the fan duct 108 can be inserted into the extension space 1381 to discharge the air into the flow space 135, so that the air discharge direction B can be parallel to the flow space 135 and the rear plate 110, thereby reducing the turbulent flow of air.

In addition, the air discharge portion 1082 can be disposed at an end of the fan duct 108 facing toward the flow space 135. For example, the air discharge portion 1082 can correspond to the end of the fan duct 108. The air discharge portion 1082 can be inserted into the extension space 1381 to discharge the air, and the air discharge direction B can be parallel to the flow space 135 or the rear plate 110.

The air discharge portion 1082 can be constructed to divide the flow space 135 and the extension space 1381 from each other. For example, the air discharge portion 1082 can discharge the air to the flow space 135 while shielding or shielding at least a portion of an interface between the flow space 135 and the extension space 1381.

FIG. 19 shows a state in which the air discharge portion 1082 shields or covers an entirety of the boundary region of the flow space 135 and the extension space 1381. That is, the air discharge portion 1082 can be in contact with the flow recessed surface 132 or the extended recessed surface 1383, and can have both ends thereof that may be respectively in contact with the extended circumferential surface 1385 and the flow outer circumferential surface 134 respectively facing thereto along the circumferential direction of the flow space 135.

The air discharge portion 1082 can be formed in a shape of an arc extending along the circumferential direction of the flow space 135. That is, the air discharge portion 1082 can have a curvature corresponding to the flow outer circumferential surface 134 and can surround an entirety of the outer circumference of the flow space 135 together with the flow outer circumferential surface 134.

The air discharge portion 1082 can have an air outlet through which the air is discharged that is defined in one surface thereof facing toward the flow space 135. The air outlet can discharge the air in a direction parallel to the flow recessed surface 132.

In some implementations, the air discharge portion 1082 of the fan duct 108 can be inserted into the extension space 1381 to divide the flow space 135 and the extension space 1381 from each other, thereby effectively blocking unnecessary air inflow into the extension space 1381.

In addition, as the air discharge portion 1082 is inserted into the extension space 1381 to discharge the air in the direction parallel to the flow recessed surface 132, it is possible to reduce the turbulent flow of air provided to the flow space 135 and improve a degree of freedom of the shape extending from the fan duct 108 except for the air discharge portion 1082.

In some implementations, as described above, the laundry treating apparatus 10 can further include the outer sealer 320 formed in an annular shape to surround the outer circumference of the air flow portion 130 and to suppress or block the air leakage.

In addition, in some implementations, the rear plate 110 can include a first seating portion 1494 of the outer sealer 320 extending along the outer circumference of the air flow portion 130 to seat the outer sealer 320 therein from the front.

In addition, the air discharge portion 1082 can include a second seating portion 1496 of the outer sealer 320 that surrounds the outer circumference of the flow space 135 together with the first seating portion 1494 of the outer sealer 320 and seats the outer sealer 320 therein from the front.

Specifically, the first seating portion 1494 of the outer sealer 320 can support the outer sealer 320 on the outer circumference of the air flow portion 130. The first seating portion 1494 of the outer sealer 320 can be disposed on the rearwardly protruding surface 149 or on the rear reference surface 111.

FIG. 18 shows that the first seating portion 1494 of the outer sealer 320 is formed on the rearwardly protruding surface 149 connected to the flow outer circumferential surface 134 and seats the outer sealer 320 therein.

The first seating portion 1494 of the outer sealer 320 can be in parallel with the rearwardly protruding surface 149 or recessed rearwardly from the rearwardly protruding surface 149. The outer sealer 320 can be coupled to and fixed to the first seating portion 1494 of the outer sealer 320.

The second seating portion 1496 of the outer sealer 320 can be disposed on the air discharge portion 1082. As described above, the air discharge portion 1082 can surround the outer circumference of the flow space 135 together with the flow outer circumferential surface, and thus, the second seating portion 1496 of the outer sealer 320 on which the outer sealer 320 is seated can be formed at a front portion of the air discharge portion 1082.

FIG. 19 shows the second seating portion 1496 of the outer sealer 320 disposed on a front surface of the air discharge portion 1082. The second seating portion 1496 of the outer sealer 320 can be recessed rearwards from an outer surface of the air discharge portion 1082, and can form a single circular shape together with the first seating portion 1494 of the outer sealer 320.

In some implementations, the circular shape may include not only a circular shape having a constant radius along a circumferential direction, but also an elliptical shape having a varying radius. That is, in some implementations, the circular shape may collectively refer to a closed curve in which a curvature varies along a circumference.

The first seating portion 1494 of the outer sealer 320 and the second seating portion 1496 of the outer sealer 320 can be continuously connected to each other, and together form one annular shape corresponding to the shape of the outer sealer 320. Accordingly, the outer sealer 320 can be seated on both of the first seating portion 1494 of the outer sealer 320 and the second seating portion 1496 of the outer sealer 320.

In some implementations, as the first seating portion 1494 of the outer sealer 320 is disposed on the flow outer circumferential surface 134, and at the same time, the second seating portion 1496 of the outer sealer 320 is disposed on the air discharge portion 1082, while ensuring airtightness of the flow space 135, it is possible to effectively block the air flowing out from the air flow portion 130 from leaking to the inlet extension 138.

In some implementations, the fan duct 108 can further include a fan duct extension 1084. The fan duct extension 1084 can extend from the air discharge portion 1082 outwardly of the extension space 1381 and can be coupled to the rear plate 110.

In addition, the rear plate 110 can include a fan duct coupling portion 1491, and the fan duct coupling portion 1491 can be recessed rearwards outwardly of the inlet extension 138, so that the fan duct extension 1084 can be seated in the fan duct coupling portion 1491 from the front.

Referring to FIG. 19, the fan duct extension 1084 can extend from the air discharge portion 1082 outwardly of the air flow portion 130 and the inlet extension 138. Accordingly, it is possible to prevent a situation in which a coupling portion for coupling with the air discharge portion 1082 is generated in the flow space 135 or the extension space 1381 to obstruct the flow of air or to allow the air leakage to occur.

The fan duct extension 1084 can extend from the air discharge portion 1082 along the circumferential direction of the air flow portion 130. That is, the fan duct extension 1084 can extend along the outer circumference of the flow space 135. Accordingly, the air discharge portion 1082 can form a single arc shape including the fan duct extension 1084.

The fan duct extension 1084 can be seated on the rearwardly protruding surface 149. That is, the fan duct coupling portion 1491 can be disposed on the rearwardly protruding surface 149. FIG. 20 shows the fan duct coupling portion 1491 on which the fan duct extension 1084 is seated.

The fan duct coupling portion 1491 can be recessed rearwards from the rearwardly protruding surface 149, so that the fan duct extension 1084 can be seated in the fan duct coupling portion 1491 from the front. The fan duct extension 1084 can extend from a front portion of both ends of the air discharge portion 1082 along the circumferential direction of the air flow portion 130 to be seated on the rearwardly protruding surface 149.

Because the fan duct extension 1084 extends from the air discharge portion 1082 inserted into the extension space 1381, the fan duct coupling portion 1491 can be formed in a shape of a groove open toward the extension space 1381 to prevent a gap from occurring when the fan duct extension 1084 is coupled thereto.

Figure 22:
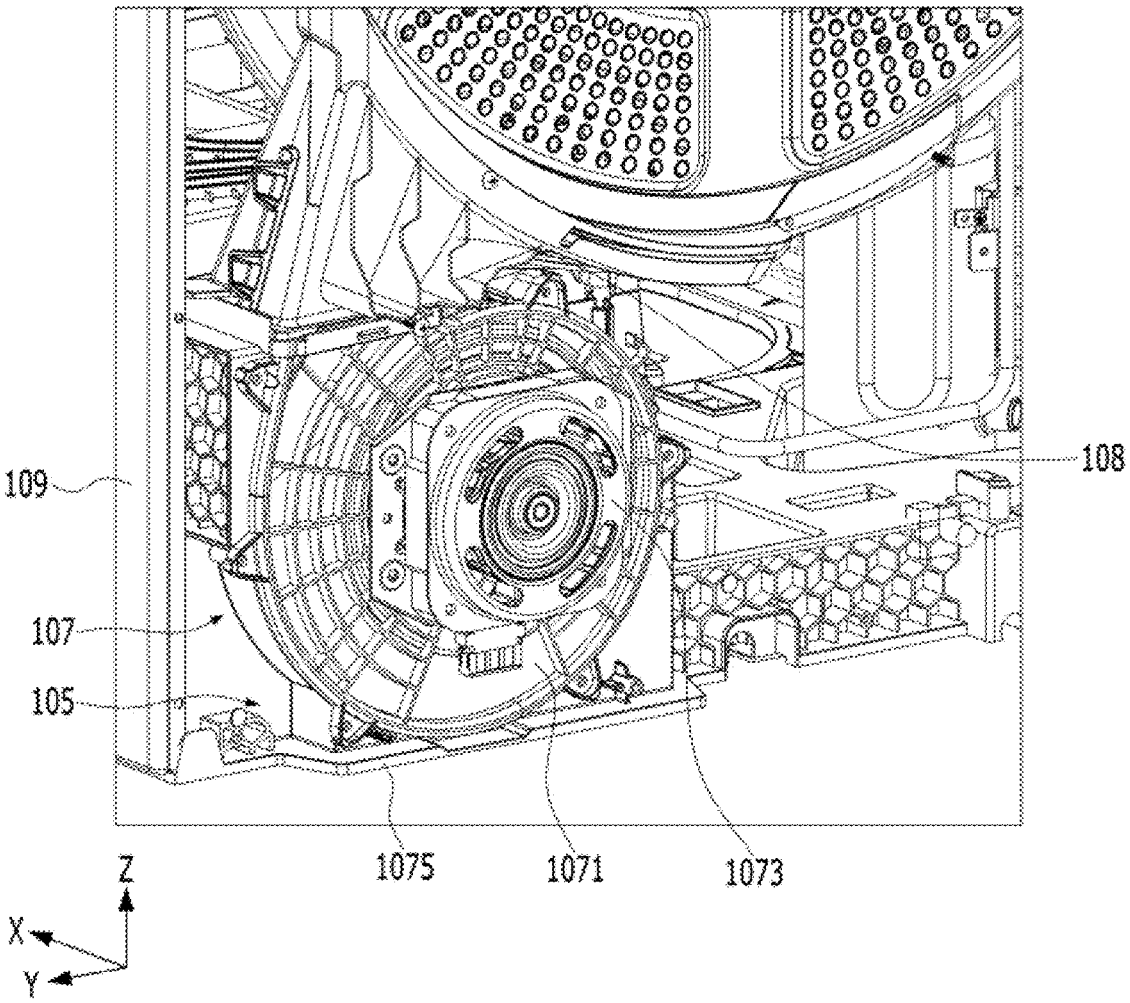
FIG. 22 is a diagram illustrating a view a blower in an exemplary laundry treating apparatus from the rear.

FIG. 21 is a diagram illustrating the blower 107 inserted into the extension space 1381 from the front of the inlet extension 138, and FIG. 22 is a diagram illustrating the blower motor 1073 coupled to the blower fan housing from the rear.

Referring to FIGS. 21 and 22, in some implementations, the blower 107 can include the blower fan 1071 and the blower motor 1073, and can be at least partially inserted into the extension space 1381 and blow the air into the fan duct.

As described above, the blower 107 can be located at the rear of the air supply 106, and can rearwardly face the inlet extension 138. In the blower 107, the blower fan housing and the blower motor 1073 are at least partially inserted into the extension space 1381, so that a length in the front and rear direction of an entirety of the air supply 106 may be sufficiently secured.

In some implementations, the blower fan 1071 of the blower 107 can be located inside the rear protrusion 140, and the blower motor 1073 can be disposed at the rear of the blower fan 1071 and inserted into the extension space 1381.

In some implementations, the rear plate 110 can define the space therein as the rear protrusion 140 and the inlet extension 138 protrude rearwards in a stepped manner. In the blower 107, the blower motor 1073 can be disposed at the rear of the blower fan 1071 or the blower fan housing.

Accordingly, in the blower 107, the blower fan 1071 or the blower motor 1073 located at the rear of the blower fan housing can be inserted into the extension space 1381, and the blower fan 1071 or the blower fan housing positioned in front of the blower motor 1073 can be at least partially located in the space inside the rear protrusion 140.

The blower motor 1073 can be inserted into the extension space 1381, and the blower motor 1073 can be coupled with the extended recessed surface 1383. Thus, in some implementations, a plurality of power generators corresponding to a motor and the like can be disposed on the rear plate 110. That is, in some implementations, the rear plate 110 can form a coupling relationship with the blower motor 1073 and the driver 400.

In one example, FIG. 22 shows the blower fan support 1075 protruding rearwards from the base 105 or the bottom plate 103 to support the blower fan housing.

Referring to FIG. 22, in some implementations, the air supply 106 can include the blower fan support 1075, and the blower fan support 1075 can support the blower fan 1071 from below.

In addition, in the rear protrusion 140, the rear outer circumferential surface 148 can include a support insertion portion 1482 into which the blower fan support 1075 is inserted from the front. As described above, the blower fan 1071 is inserted into the rear protrusion 140, so that the blower fan support 1075 located beneath the blower fan 1071 can also be inserted into the rear protrusion 140.

Accordingly, the rear protrusion 140 can have the support insertion portion 1482 into which the blower fan support 1075 is inserted from the front, and the support insertion portion 1482 can form a coupling relationship with the blower fan support 1075.

A shape of the support insertion portion 1482 may vary. For example, the support insertion portion 1482 can be defined in the rearwardly protruding surface 149 such that the blower fan support 1075 is inserted thereinto from the front, or can be defined in the rear outer circumferential surface 148 such that the support insertion portion 1482 can be inserted thereinto.

The support insertion portion 1482 can be open frontwards and can include a space defined therein into which the blower fan support 1075 is inserted. The space can correspond to a portion of the space defined inside the rear protrusion 140 or can be defined separately.

In some implementations, as the blower fan support 1075 that supports the blower fan 1071 is disposed on the base 105 or the bottom plate 103, the blower fan 1071 or the blower fan housing can be stably fixed and supported. As a center of rotation of the blower fan 1071 is aligned with a center of the air flow channel of the air supply 106, the fluidity of the air can be improved.

Furthermore, in some implementations, as the support insertion portion 1482 into which the blower fan support 1075 is inserted is defined in the rear plate 110, that is, the rear protrusion 140, at least a portion of the blower fan 1071 and the blower fan housing including the blower fan support 1075 can be effectively accommodated inside the rear protrusion 140.

Figure 23:
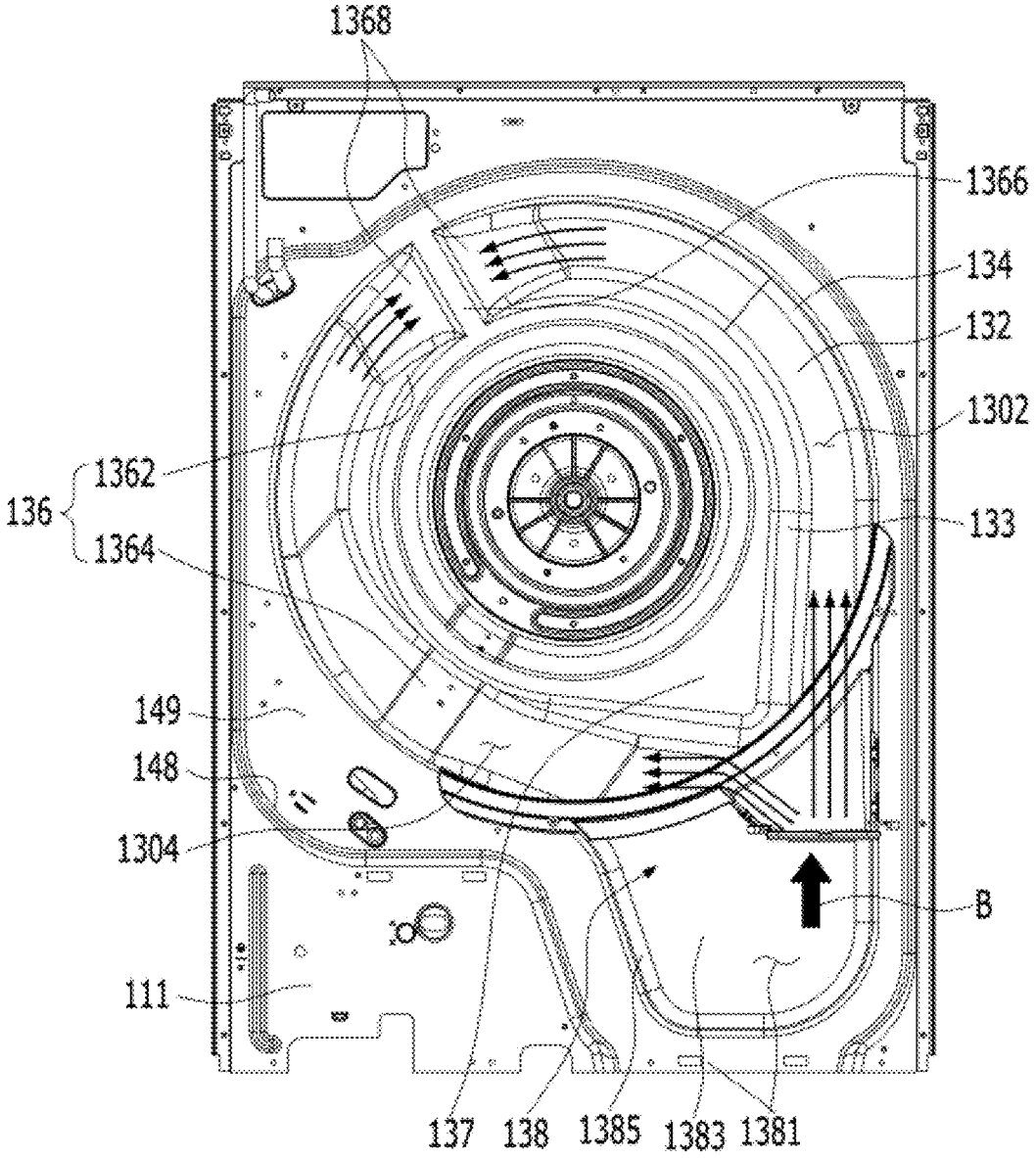
FIG. 23 is a diagram illustrating an example of an air guide disposed in an air flow portion.

FIG. 23 is a diagram illustrating an air guide formed in the air flow portion 130.

Referring to FIG. 23, the air guide can guide the flow of air inside the air flow portion 130, and can include an outflow guide 136 and an inflow guide 137. The outflow guide 136 can protrude from the flow recessed surface 132 toward the air passage 230 to guide the flow of air toward the air passage 230.

The outflow guide 136 can include a first outflow guide 1362 and a second outflow guide 1364. The first outflow guide 1362 can be located on the opposite side of the air supply 106 with respect to the center of the air flow portion 130, and can have a maximum protrusion height in the flow recessed surface 132 equal to or greater than the depth of the flow space 135.

The second outflow guide 1364 can be positioned between the first outflow guide 1362 and the air supply 106 along the circumference of the flow space 135, and can have a maximum protrusion height in the flow recessed surface 132 less than the depth of the flow space 135.

The inflow guide 137 can be disposed on the flow inner circumferential surface 133, and protrude toward the air supply 106 to guide the flow of air supplied from the air supply 106.

Figure 24:
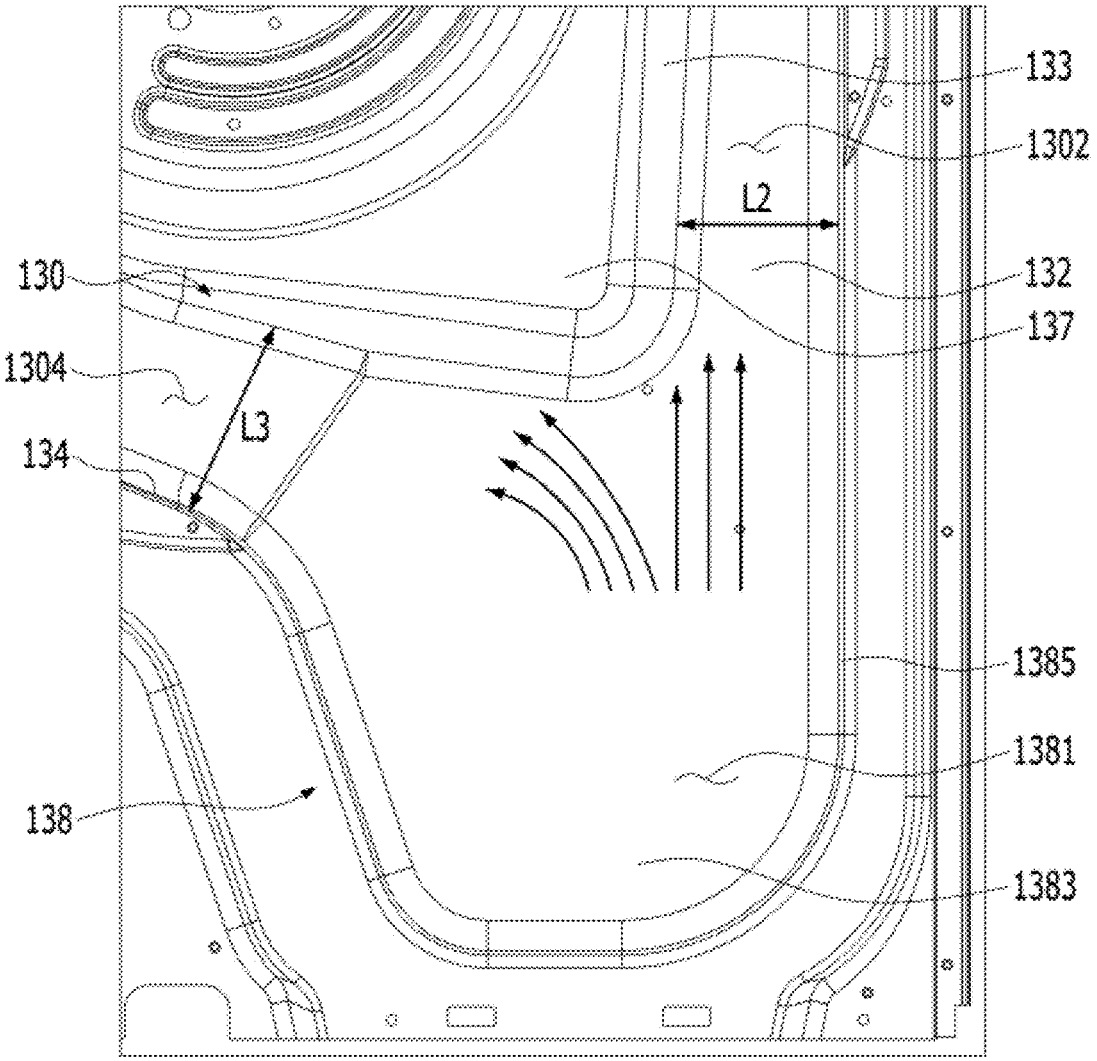
FIG. 24 is a diagram illustrating an example of an inflow guide of an air flow portion.
Figure 25:
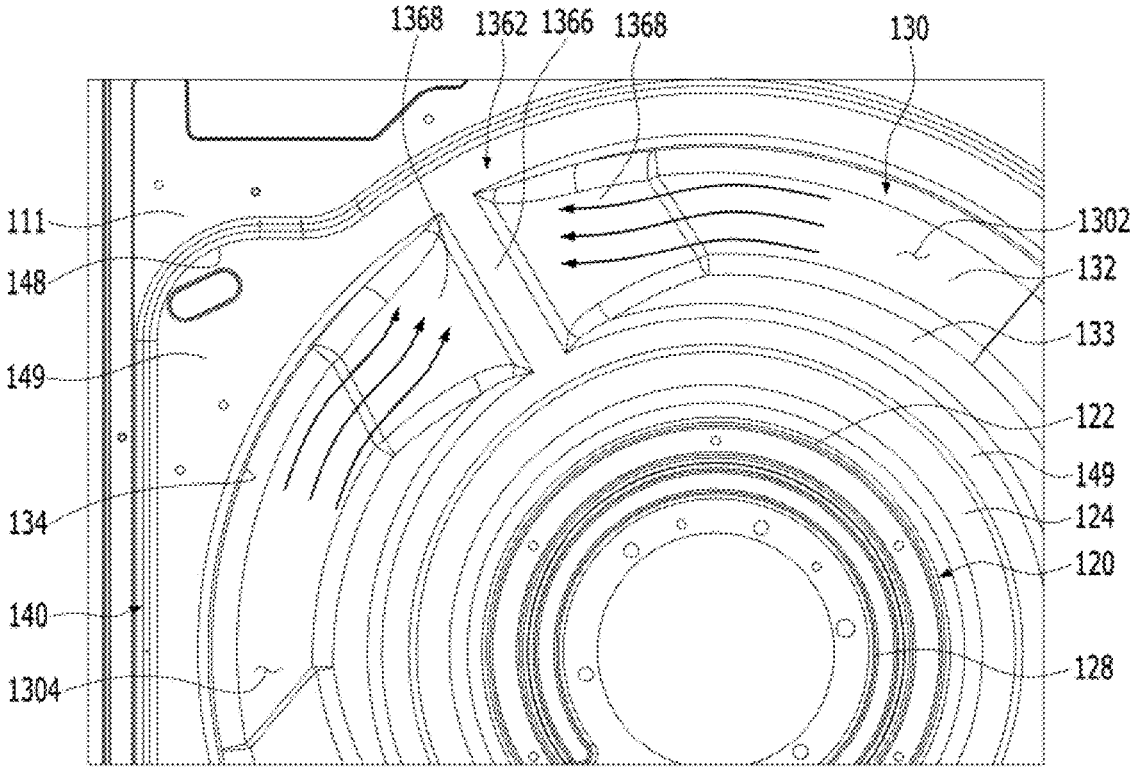
FIG. 25 is a view showing a first outflow guide of an air flow portion in an embodiment of the present disclosure.
Figure 26:
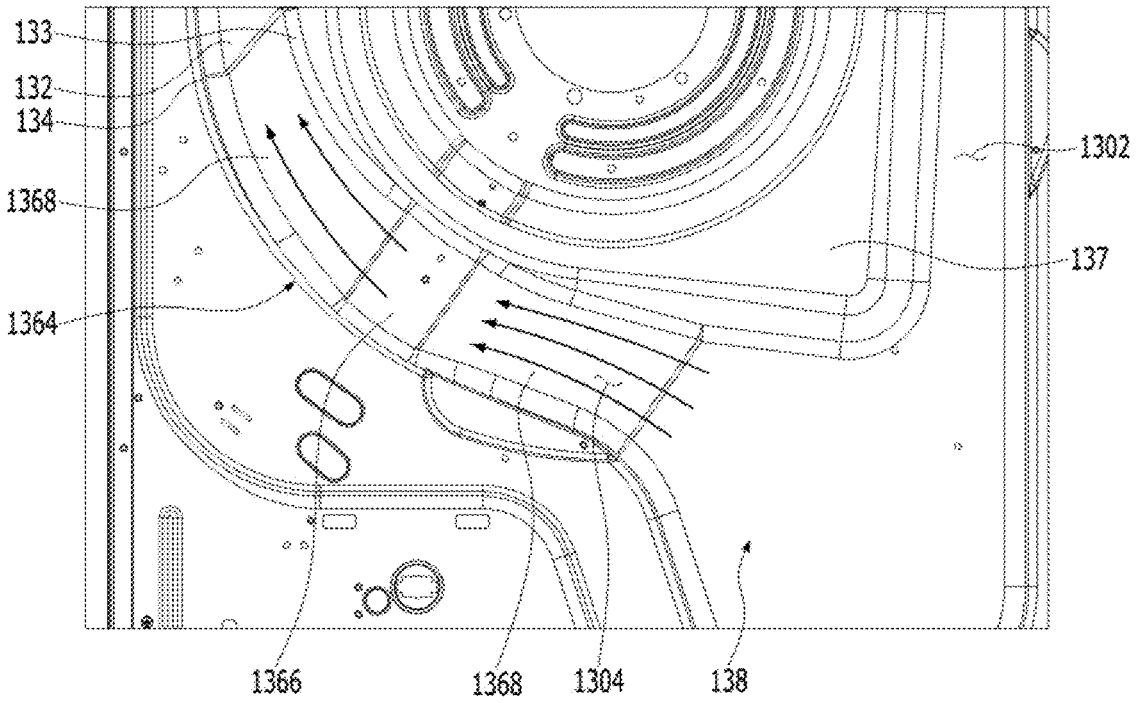
FIG. 26 is a diagram illustrating an example of a second outflow guide of an air flow portion.

FIG. 24 is a diagram illustrating the inflow guide 137, FIG. 25 is a diagram illustrating the first outflow guide 1362, and FIG. 26 is a diagram illustrating the second outflow guide 1364.

Referring to FIGS. 24 to 26, the air guide will be described in detail as follows.

The air guide can protrude in the flow space 135 to guide the flow of air. The air guide can be formed in a shape protruding from the flow space 135 to guide the air flow.

The air supplied from the air supply 106 flows in the flow space 135, and the air guide guides the flow of air flowing in the flow space 135, thereby ameliorating a flow resistance, improving uniformity of the air flowing out to the drum rear surface 210, or reducing the turbulent flow to increase the air flow rate of the circulation flow channel and increase the drying efficiency of the drum 200.

The air guide can be formed in various shapes at various locations. For example, the air guide can be formed in a shape protruding into the flow space 135 from one of the flow outer circumferential surface 134, the flow inner circumferential surface 133, and the flow recessed surface 132.

The air guide can be manufactured separately and coupled to an inner surface of the air flow portion 130, that is, the flow outer circumferential surface 134, the flow inner circumferential surface 133, and the flow recessed surface 132 can be integrally molded with the inner surface.

The air guide can be positioned to face the air supply 106 to guide the flow of air introduced from the air supply 106, or can be positioned at any point in the flow space 135 that is spaced apart from the air supply 106 to guide the flow of air flowing through the flow space 135.

The air guide can protrude from the inner surface of the air flow portion 130 toward the drum rear surface 210 to guide the air in the flow space 135 to flow to the drum rear surface 210, or can protrude toward the air supply 106 to guide a flow direction of the air introduced into the flow space 135.

In some implementations, referring to FIGS. 23 and 25, the laundry treating apparatus 10 can include the air supply 106 and the inlet extension 138 described above, and the air flow portion 130 can include the inflow guide 137.

The inflow guide 137 can correspond to the air guide, and the inflow guide 137 can be positioned to face the inlet extension 138 to guide a direction in which the air discharged from the air supply 106 flows into the air flow portion 130.

As described above, the air flow portion 130 can be defined in an approximately annular shape to surround the driver mounting portion 120, the inlet extension 138 extends from one side of the air flow portion 130, and the air supply 106 discharges the air from the inlet extension 138, thus, the air flowing into the air flow portion 130 from the air supply 106 can be introduced by being branched into one direction and the other direction based on the circumferential directions of the air flow portion 130.

In FIGS. 23 and 24, a state in which the air flowing into the flow space 135 from the air supply 106 flows by being branched into one direction and the other direction is conceptually represented by an arrow.

In some implementations, the air flow portion 130 can include a first extended flow channel 1302 extending along one direction of the circumferential directions of the air flow portion 130 based on the air supply 106, and a second extended flow channel 1304 extending in a direction opposite to said one direction.

That is, in the air flow portion 130, the first extended flow channel 1302 and the second extended flow channel 1304 can define the air flow portion 130 together to form one annular shape. The first extended flow channel 1302 and the second extended flow channel 1304 can be conceptually distinguished and defined based on the extending directions on the basis of the air supply 106.

That is, a portion of the air flow portion 130 extending in one direction with respect to the air supply 106 can be defined as the first extended flow channel 1302, and the remainder extending in the other direction can be defined as the second extended flow channel 1304.

The first extended flow channel 1302 and the second extended flow channel 1304 can be defined in a shape connected to each other to form the annular shape together. The first extended flow channel 1302 and the second extended flow channel 1304 can be connected to each other on the opposite side of the air supply 106 with respect to the air supply 106 and the center of the air flow portion 130.

FIGS. 23 and 24 show the first extended flow channel 1302 extending in one direction and the second extended flow channel 1304 extending in the other direction with respect to the air supply 106.

In some implementations, said one direction may be a counterclockwise direction when viewing the air flow portion 130 from the front, and the other direction may be a clockwise direction. However, when necessary, said one direction may correspond to the clockwise direction and the other direction may correspond to the counterclockwise direction.

When the first extended flow channel 1302 and the second extended flow channel 1304 are defined in the air flow portion 130, in some implementations, the air introduced into the flow space 135 from the air supply 106 can be branched and introduced into the first extended flow channel 1302 and the second extended flow channel 1304.

Accordingly, the laundry treating apparatus 10 can guide the inflow direction and the inflow amount of the air introduced from the air supply 106 by disposing the inflow guide 137 at a position facing the air supply 106.

The inflow guide 137 can protrude frontwards from the inlet recessed surface, protrude from the flow inner circumferential surface 133 toward the air supply 106, or protrude from the flow outer circumferential surface 134.

The inflow guide 137 can be at least partially positioned on the air discharge direction B of the air supply 106, and can be located approximately between the center of the air flow portion 130 and the air supply 106. That is, the inflow guide 137 can be positioned between the driver mounting portion 120 and the air supply 106.

The inflow guide 137 can guide the flow of air discharged from the air supply 106 to adjust a ratio of flow rates of the air introduced into the first extended flow channel 1302 and the second extended flow channel 1304 or appropriately adjust the flow direction of the air introduced into each of the first extended flow channel 1302 and the second extended flow channel 1304, thereby improving the fluidity.

That is, the laundry treating apparatus 10 can supply the air from the drum rear surface 210 by forming the effective flow of air by improving the air uniformity of the entire air flow portion 130 through the inflow guide 137, or, when necessary, increasing the flow rate of one of the first extended flow channel 1302 and the second extended flow channel 1304.

In some implementations, the inflow guide 137 can be disposed on the flow inner circumferential surface 133 and protrude from the air supply 106. FIGS. 23 and 24 show the inflow guide 137 disposed on the flow inner circumferential surface 133.

When the inflow guide 137 protrudes from the flow recessed surface 132 or the like, a portion of the air whose flow direction is guided when being in contact with the inflow guide 137 can flow along the circumference of the inflow guide 137. Accordingly, the air may not effectively follow the intended flow direction through the inflow guide 137 or may form the turbulent flow.

Therefore, in some implementations, as the inflow guide 137 is disposed on the flow inner circumferential surface 133, the inflow guide 137 may easily protrude from the air supply 106 and may effectively guide the flow direction of air.

In some implementations, in the air flow portion 130, a portion of the flow inner circumferential surface 133 can extend to protrude toward the air supply 106 to form the inflow guide 137.

In some implementations, the inflow guide 137 can correspond to a portion of the flow inner circumferential surface 133. That is, a portion of the flow inner circumferential surface 133 facing the air supply 106 can protrude toward the flow space 135 to form the inflow guide 137.

Accordingly, the inflow guide 137 can have a shape protruding frontwards from the flow recessed surface 132 such that a space is defined rearwardly. FIG. 14 is a view of the inflow guide 137 integrally formed with the flow recessed surface 132 and the flow inner circumferential surface 133 of the air flow portion 130 viewed from the rear.

In some implementations, as the inflow guide 137 is formed as the portion of the flow inner circumferential surface 133, the inflow guide 137 can be molded together in the process of molding the rear plate 110 including the air flow portion 130 or the like, which may be advantageous in manufacturing.

In some implementations, referring to FIG. 23, in the flow inner circumferential surface 133, a portion corresponding to the inflow guide 137 can extend in a straight line, and the remaining portion can extend in a curved line.

As described above, in some implementations, the air flow portion 130 can be formed in an annular shape. Therefore, the flow outer circumferential surface 134 and the flow inner circumferential surface 133 can also form approximately annular circumferences and surround the flow space 135.

However, in some implementations, the flow inner circumferential surface 133 can include the inflow guide 137 protruding towards the air supply 106. Accordingly, the flow inner circumferential surface 133 can have an annular shape in which a portion of the circumference protrudes outward in the radial direction.

For example, the flow inner circumferential surface 133 can have a streamlined shape. That is, the flow inner circumferential surface 133 can have the streamlined shape of extending in a curve corresponding to the circumferential shape of the circle in a portion except for the inflow guide 137, and extending straight from the inflow guide 137 towards the air supply 106.

The inflow guide 137 can be formed in a shape that becomes narrower in a direction toward the air supply 106 based on the circumferential direction of the air flow portion 130. That is, the inflow guide 137 can have a shape protruding sharply from the flow inner circumferential surface 133 toward the air supply 106.

Accordingly, in some implementations, the air discharged from the air supply 106 can be effectively separated and flowed through the inflow guide 137 extending with an outer portion in an approximately straight shape.

Furthermore, the air branched into the first extended flow channel 1302 and the second extended flow channel 1304 through the inflow guide 137 can be improved in the fluidity as the flow resistance and the turbulent flow are effectively ameliorated by the flow inner circumferential surface 133, which extends in a curve corresponding to the circumferential shape.

In some implementations, in the air supply 106, an amount of air flowing toward the first extended flow channel 1302 is greater than an amount of air flowing toward the second extended flow channel 1304.

In addition, the inflow guide 137 can guide the portion of the air flowing toward the first extended flow channel 1302 toward the second extended flow channel 1304.

In some implementations, the air supply 106 can be formed such that the air is discharged at a location closer to the first extended flow channel 1302 among the first extended flow channel 1302 and the second extended flow channel 1304. Accordingly, the amount of air supplied to the first extended flow channel 1302 can be greater than the amount of air supplied to the second extended flow channel.

That is, in some implementations, as the air flow rates of the first extended flow channel 1302 and the second extended flow channel 1304 are set differently, a region in which the air is intensively discharged of the open front surface 131 of the air flow portion 130 may be set, and the air can be efficiently supplied into the drum 200.

The flow rates of air supplied to the first extended flow channel 1302 and the second extended flow channel 1304 can be determined through flow analysis of the air introduced into and discharged from the drum 200, or can be determined from a strategic aspect in consideration of the drying efficiency.

For example, the laundry treating apparatus 10 can supply a large amount of air to the air passage 230 through the open front surface of the first extended flow channel 1302 as the air is concentrated to the first extended flow channel 1302, and can supply the air to the air passage 230 through the front surface of the second extended flow channel 1304 while relieving the flow resistance of the first extended flow channel 1302 by flowing a portion of air to the second extended flow channel 1304.

Referring to FIG. 4, as described above, the air supply 106 can be positioned to be biased to one side in the lateral direction below the drum 200. In this case, one of the first extended flow channel 1302 and the second extended flow channel 1304 can be located at a relatively lower portion of the air flow portion 130, and the other can be located at a relatively upper portion of the air flow portion 130.

Even when being partially lifted along the rotation direction of the drum 200 from the inner surface of drum 200 by the rotation of the drum 200 in the drying process, the laundry accommodated inside the drum 200 may be distributed generally at the lower portion inside the drum 200 by a self-weight.

In this case, supplying the air from the air passage 230 to a region corresponding to the lower portion inside the drum 200 may cause strong flow resistance by the laundry inside the drum 200, which may be disadvantageous in air circulation.

Therefore, the laundry treating apparatus 10 can relatively increase the flow rate of air supplied to the first extended flow channel 1302 located on one side in the lateral direction of the air flow portion 130 and above the air flow portion 130, and decrease the flow rate of air supplied to the second extended flow channel 1304 located on the other side in the lateral direction of the air flow portion 130 and below the air flow portion 130, thereby effectively reducing the flow resistance of air supplied to the air passage 230 and supplying the air into the drum 200.

In addition, flowing the air only into the first extended flow channel 1302 may be disadvantageous because only a limited flow channel is used in the entire air flow portion 130, and thus the flow resistance of the first extended flow channel 1302 is increased.

Therefore, in some implementations, while increasing the air flow rate of the first extended flow channel 1302, an amount of air equal to or greater than a certain amount is flowed into the second extended flow channel 1304, so that it is possible to ameliorate the flow resistance in the entire air flow portion 130 and to improve the uniformity of the outflowing air, thereby performing the effective drying process.

In the air supply 106, the air discharge direction B may be set in terms of design, such as a direction in which the air outlet through which the air is discharged from the fan duct 108 is directed. In some implementations, the blower fan 1071 that causes the air flow in the air supply 106 can discharge the air in a tangential direction thereof, and the tangential direction of the blower fan 1071, that is, the flow direction of air discharged from the blower fan 1071 can be directed toward the first extended flow channel 1302.

That is, in some implementations, the blower fan housing can be constructed such that a portion thereof in connection with the fan duct 108 faces toward the first extended flow channel 1302 as the tangential direction of the blower fan 1071, the fan duct 108 can also extend generally parallel to the tangential direction of the blower fan 1071, and a portion where the air outlet is opened, that is, where the air is discharged may be located closer to the first extended flow channel 1302 than to the second extended flow channel 1304, so that a relatively large amount of air can be supplied to the first extended flow channel 1302 while minimizing and reducing the turbulent flow of the air from the blower fan 1071 to the first extended flow channel 1302.

However, as described above, because it is necessary to provide the air flow rate equal to or greater than the certain amount to the second extended flow channel 1304, the air discharge direction B of the air supply 106 may not be completely directed toward the first extended flow channel 1302, or a portion of the air discharged from the air supply 106 may flow out of the first extended flow channel 1302.

In addition, the inflow guide 137 may separate a portion of the air flowing mainly to be introduced into the first extended flow channel 1302 by the air supply 106 to flow the separated air into the second extended flow channel 1304 instead of the first extended flow channel 1302.

That is, the inflow guide 137 may be disposed closer to the first extended flow channel 1302, and may branch the flow of the portion of air toward the first extended flow channel 1302 to be directed to the second extended flow channel 1304. For example, an end of the inflow guide 137 protruding from the flow inner circumferential surface 133 may be disposed closer to the first extended flow channel 1302 than to the second extended flow channel 1304.

In some implementations, the driver 400 can rotate the drum 200 such that the drum 200 rotates more in the other direction than in said one direction in the drying process of the laundry.

In addition, the air of the first extended flow channel 1302 flowing along said one direction can be introduced into the drum 200 while the drum 200 is rotated in the other direction.

Specifically, in the treating laundry treating apparatus 10, in the drying process of the laundry, the driver 400 can rotate the drum 200 and the air can be supplied into the drum 200 through the air flow portion 130.

The driver 400 can rotate the drum 200 such that, while the air is supplied from the air flow portion 130, the drum 200 rotates more in said other direction than in the one direction. The rotation direction and the rotation speed of the driver 400 can be adjusted by a controller.

As described above, in some implementations, the first extended flow channel 1302 can extend in one direction from the air supply 106, and the second extended flow channel 1304 can extend in the other direction.

Accordingly, the air flowing through the first extended flow channel 1302 can flow in said one direction, and the air flowing through the second extended flow channel 1304 can flow in the other direction.

In some implementations, as described above, the flow rate of air introduced into the first extended flow channel 1302 may be greater than the flow rate of air introduced into the second extended flow channel 1304. Therefore, it is important to improve the fluidity of the air supplied to the air passage 230 through the first extended flow channel 1302.

Accordingly, the controller can control the driver 400 in the drying process of the laundry to rotate the drum 200 such that the amount of rotation of the drum 200 in the other direction is greater than the amount of rotation in said one direction, so that a relative velocity of the air flowing in one direction along the first extended flow channel 1302 is increased with respect to that of the air in the air passage 230 rotating in the other direction, thereby effectively improving the amount of inflow into the drum 200 through the air passage 230.

In addition, as described above, when the drum 200 is rotated in the other direction, the laundry inside the drum 200 can be rotated in the other direction along the inner surface of the drum 200 at the lower portion of the inner drum 200 by friction with the drum circumferential surface 290, the laundry lifter 280, or the like.

In this connection, the laundry lifted upwards in the drum 200 can be dropped downwards from an uppermost end of the drum 200 or a point spaced apart in one direction from the uppermost end by the self-weight.

Therefore, inside the drum 200, a region spaced apart from the uppermost end of the drum 200 in the other direction has a low distribution of the laundry based on the inner surface of the drum 200, which may facilitate the air inflow, and has an increased contact area between the inflow air and the laundry, which may be advantageous in terms of the drying efficiency, so that the region spaced apart from the uppermost end of the drum 200 in the other direction can correspond to a region into which the air for drying the laundry is introduced in a concentrated manner.

Accordingly, in some implementations, a main rotation direction of the drum 200 is set to the other direction, and a large amount of air flows into the first extended flow channel 1302 extending in one direction from the air supply 106 or the inlet extension 138, so that the air may be effectively introduced into the drum 200 through the air flow portion 130, and the flow resistance of air may be effectively ameliorated to improve the drying efficiency of the laundry.

The drum 200 can be rotated only in the other direction in the entire drying process of the laundry, or can be rotated in one direction and the other direction, but have the rotation amount in the other direction greater than the rotation amount in one direction.

In some implementations, in addition to the case in which the main rotation direction of the drum 200 is determined based on the air flow rates of the first extended flow channel 1302 and the second extended flow channel 1304, the main rotation direction of the drum 200 may be determined first, and the air flow rates of the first extended flow channel 1302 and the second extended flow channel 1304 by the air supply 106 and the inflow guide 137 may be determined depending on the main rotation direction of the drum 200.

In some implementations, referring to FIGS. 23 and 24, the first extended flow channel 1302 and the second extended flow channel 1304 can be defined between the flow inner circumferential surface 133 and the flow outer circumferential surface 134, and the inflow guide 137 can be constructed such that a separation distance L2 from the flow outer circumferential surface 134 of the first extended flow channel 1302 is smaller than a separation distance L3 from the flow outer circumferential surface 134 of the second extended flow channel 1304.

As described above, in some implementations, the inflow guide 137 can be formed as a portion of the flow inner circumferential surface 133 protrudes toward the air supply 106. In one example, a protruding direction of the inflow guide 137 may be designed closer to the first extended flow channel 1302 than to the second extended flow channel 1304.

In the first extended flow channel 1302 and the second extended flow channel 1304, an air inflow region facing toward the air supply 106 can be defined between the inflow guide 137 and the flow outer circumferential surface 134. In the inflow guide 137, the separation distance L2 from the flow outer circumferential surface 134 of the first extended flow channel 1302 may be smaller than the separation distance L3 from the flow outer circumferential surface 134 of the second extended flow channel 1304.

For example, in some implementations, the inflow guide 137 can protrude along the radial direction of the air flow portion 130, and can protrude closer to the first extended flow channel 1302 than to the second extended flow channel 1304.

That is, the first extended flow channel 1302 can have a width defined by the inflow guide 137 and the flow outer circumferential surface 134 smaller than a width of the second extended flow channel 1304. A portion of the air flowing toward the first extended flow channel 1302 can be blocked from flowing into the first extended flow channel 1302 and can be directed toward the second extended flow channel 1304.

In one example, FIGS. 25 and 26 show the outflow guide 136. In some implementations, the air guide can include the outflow guide 136.

Referring to FIGS. 25 and 26, the outflow guide 136 can protrude from the flow recessed surface 132 that shields or covers the flow space 135 from the rear in the air flow portion 130 toward the air passage 230 to guide the air in the flow space 135 to flow toward the air passage 230.

In some implementations, the air may flow along the circumferential direction of the air flow portion 130 in the flow space 135, and may be discharged frontwards through the open front surface 131 of the air flow portion 130. However, because the main flow direction of the air in the flow space 135 is not a forward direction, the laundry treating apparatus 10 may guide the air in the flow space 135 to flow frontwards through the outflow guide 136.

The outflow guide 136 may protrude from the flow recessed surface 132 frontwards, that is, toward the air passage surface 239. The air passing through an outflow portion may flow frontwards by protrusion of the outflow portion.

Accordingly, in some implementations, the air can be effectively discharged through the open front surface 131 from the air flow portion 130, and the air from the air flow portion 130 can be supplied into the drum 200 through the air passage 230.

A shape or the number of outflow guides 136 may vary. FIGS. 25 and 26 show a state in which the flow recessed surface 132 is formed to protrude frontwards to form the outflow guide 136.

In one example, in some implementations, the outflow guide 136 can be connected to the flow outer circumferential surface 134 and the flow inner circumferential surface 133. That is, the outflow guide 136 can be connected to the flow recessed surface 132, the flow outer circumferential surface 134, and the flow inner circumferential surface 133 to flow the air frontwards.

When there is a gap between the outflow guide 136 and the flow inner circumferential surface 133 or the flow outer circumferential surface 134, the air may flow to the space between the outflow portion and the flow inner circumferential surface 133 or the flow outer circumferential surface 134, so that the flow may not be guided frontwards by the outflow guide 136.

Accordingly, in some implementations, the outflow guide 136 can be connected to the flow outer circumferential surface 134 and the flow inner circumferential surface 133 to guide the flow of an entirety of air passing through the outflow guide 136 frontwards.

In some implementations, the outflow guide 136 can be formed as the flow recessed surface 132 is bent or curved toward the air passage 230. That is, the outflow guide 136 can be formed as a portion of the flow recessed surface 132.

For example, the outflow guide 136 can be molded on the rear plate 110 together in the process in which the air flow portion 130 is molded through the pressing method or the like. FIG. 14 shows the outflow guide 136 viewed from the rear.

The outflow guide 136 can be connected to the flow outer circumferential surface 134 and the flow inner circumferential surface 133. Therefore, a space in which the flow recessed surface 132 is recessed frontwards together with the flow outer circumferential surface 134 and the flow inner circumferential surface 133 can be defined at the rear of the outflow guide 136.

In some implementations, the laundry treating apparatus 10 can include a power line. The power line can be withdrawn from the driver mounting portion 120 at the rear of the rear plate 110 and can supply power to the driver 400.

The power line can extend rearwardly from the driver mounting portion 120 along the mounting side surface 124 and/or the mounting front surface 122 to be withdrawn outwardly from the driver mounting portion 120 at the rear of the rear plate 110. The power line can be connected to a power port disposed on the mounting front surface 122 or the mounting side surface 124 of the driver mounting portion 120.

In some implementations, the air flow portion 130 can have a space in which the power line extends defined as a rear portion of the outflow guide 136 is recessed frontwards. As described above, in some implementations, a portion of the flow recessed surface 132 can be raised to protrude frontwards to form the outflow guide 136.

The outflow guide 136 can be connected to the flow outer circumferential surface 134 and the flow inner circumferential surface 133. Accordingly, a space that is opened along the radial direction of the air flow portion 130 and is recessed frontwards can be defined at the rear of the outflow guide 136.

The power line extending from the driver mounting portion 120 can extend along the rear surface of the outflow guide 136 to extend outwardly of the air flow portion 130 while crossing the outflow guide 136. The power line can be recessed into the cabinet 100 through an extended protruding region of the rear protrusion 140.

In some implementations, when the air flow portion 130 surrounding the driver mounting portion 120 may protrude rearwards from the rear plate 110, and the power line extending outwardly of the driver mounting portion 120 at the rear of the rear plate 110 extends outwardly of the air flow portion 130 while crossing the air flow portion 130, an extended length of the power line can be increased by the air flow portion 130 protruding rearwards.

In addition, in some implementations, the rear cover 500 may be coupled to the rear plate 110 from the rear, and the power line extending across the flow recessed surface 132 or the like of the air flow portion 130 may cause structural interference between the rear cover 500 and the rear plate 110, such as separating the flow cover rear surface 514 of the rear cover 500 and the flow recessed surface 132 from each other, separating the flow cover outer circumferential surface 512 and the flow outer circumferential surface 134 from each other, or the like.

Therefore, in some implementations, at the same time as the outflow guide 136 is formed to flow the air in the flow space 135 frontwards, the outflow guide 136 is formed as a portion of the flow recessed surface 132 to define a space that is opened in the radial direction of the air flow portion 130 and is recessed frontwards at the rear portion of the outflow guide 136, so that influence of the power line withdrawn from the driver mounting portion 120 on the coupling of the rear cover 500 may be minimized and the power line may extend while being stably fixed.

Referring back to FIGS. 25 and 26, in some implementations, the outflow guide 136 can include a guide central portion 1366 and a guide inclined portion 1368. The guide central portion 1366 can protrude from the flow recessed surface 132 toward the air passage 230.

The guide inclined portion 1368 can extend along the circumferential direction of the air flow portion 130 from the guide central portion 1366, and can have a height of protrusion from the flow recessed surface 132 decreasing as a distance from the guide central portion increases.

The outflow guide 136 including the guide central portion 1366 and the guide inclined portion 1368 can be formed in a shape of a hill in the flow space 135. The guide central portion 1366 can include a region of maximum protrusion from the flow recessed surface 132 in the outflow guide 136, and the guide inclined portions 1368 can extend in one direction and the other direction, respectively.

The guide inclined portion 1368 can extend in one direction or the other direction from the guide central portion 1366, and can have the height of protrusion from the flow recessed surface 132 gradually decreasing as the distance from the guide central portion 1366 increases.

The guide central portion 1366 and the guide inclined portion 1368 can be integrally formed with the flow recessed surface 132, the flow outer circumferential surface 134, and the flow inner circumferential surface 133, and can be formed in a curved or flat surface shape.

In some implementations, as the guide inclined portion is disposed on one side and/or the other side of the guide central portion protruding from the flow recessed surface 132 toward the air passage 230, the outflow guide 136 can minimize or reduce an occurrence of the turbulent flow of air passing through the outflow guide 136.

In one example, FIG. 23 shows the first outflow guide 1362 disposed in the air flow portion 130, and FIG. 25 is an enlarged view of the first outflow guide 1362.

In some implementations, the outflow guide 136 can include the first outflow guide 1362. The first outflow guide 1362 can be located on an opposite side of the inlet extension 138 with respect to the center of the air flow portion 130 formed in the annular shape.

As described above, the air flow portion 130 can include the first extended flow channel 1302 and the second extended flow channel 1304, and the first extended flow channel 1302 and the second extended flow channel 1304 can be connected to each other on the opposite side of the air supply 106 with respect to the center of the air flow portion 130, for example, the driver mounting portion 120.

That is, the air flowing in one direction along the first extended flow channel 1302 and the air flowing in the other direction along the second extended flow channel 1304 can meet on the opposite side of the air supply 106 in the air flow portion 130.

The air in the first extended flow channel 1302 and the air in the second extended flow channel 1304 meeting each other on the opposite side of the air supply 106 have flow directions opposite to each other. Accordingly, in the air flow portion 130, the air flows flowing opposite to each other may collide with each other on the opposite side of the air supply 106 to form the turbulent flow, generate noise and vibration, and cause a loss in the flow velocity and the hydraulic pressure.

Accordingly, in some implementations, as the first outflow guide 1362 is disposed on the opposite side of the air supply 106 in the air flow portion 130, that is, at a point where the first extended flow channel 1302 and the second extended flow channel 1304 are connected to each other, the air in the first extended flow channel 1302 and the air in the second extended flow channel 1304 can flow frontwards by the first outflow guide 1362 without colliding with each other and can be introduced into the drum 200 through the air passage 230.

Furthermore, as described above, it may be advantageous that the air is provided in a concentrated manner to the region inside the drum 200 and spaced apart from the uppermost end of the drum in one direction. It may be advantageous for the first extended flow channel 1302 facing the corresponding region, that the flow pressure is increased at the uppermost end of the drum and the region spaced apart from the uppermost end of the drum 200 in one direction to increase the flow rate of air flowing out frontwards.

Accordingly, in some implementations, the first outflow guide 1362 can be disposed at the connection point of the first extended flow channel 1302 and the second extended flow channel 1304. In the first extended flow channel 1302, the flow pressure may be increased on a portion upstream of the first outflow guide 1362 because of the increase in the flow resistance by the first outflow guide 1362.

That is, in the first extended flow channel 1302 extending along the upper portion of the air flow portion 130, a strong flow pressure of air may be formed by the first outflow guide 1362 at the upstream of the first outflow guide 1362, for example, at an uppermost end of the air flow portion 130 or a region spaced apart from the uppermost end of the air flow portion 130 in one direction. Accordingly, it is possible to effectively increase the flow rate of the air flowing out toward the air passage 230 at the uppermost end of the drum 200 or the region spaced apart from the uppermost end of the drum 200 in one direction.

In some implementations, referring to FIG. 25, the first outflow guide 1362 can have the maximum protrusion height equal to or greater than the depth of the flow space 135. For example, a protruding end of the first outflow guide, that is, the guide central portion 1366 can be positioned in parallel with the rearwardly protruding surface 149 or can protrude forwardly of the rearwardly protruding surface 149.

As described above, the first outflow guide 1362 can block the air in the first extended flow channel 1302 from colliding with the air in the second extended flow channel 1304 and increases the flow resistance of the first extended flow channel 1302 to form the maximum flow pressure at the upstream of the first outflow guide 1362.

That is, the first outflow guide 1362 can suppress the air from passing through the first outflow guide 1362 in one direction or the other direction. Accordingly, the height at which the first outflow guide 1362 protrudes from the flow recessed surface 132 can be equal to or greater than the depth of the air flow portion 130.

In one example, FIG. 23 shows the second outflow guide 1364 disposed in the air flow portion 130, and FIG. 26 is an enlarged view of the second outflow guide 1364.

Referring to FIGS. 23 and 26, in some implementations, the outflow guide 136 can include the second outflow guide 1364, and the second outflow guide 1364 can be disposed between the inlet extension 138 and the first outflow guide 1362 to guide the air flow in the flow space 135 toward the air passage 230.

The second outflow guide 1364 can be disposed between the first outflow guide 1362 and the inlet extension 138 or the air supply 106. That is, the second outflow guide 1364 can be positioned in the first extended flow channel 1302 or the second extended flow channel 1304 to guide the air passing through the second outflow guide 1364 to flow frontwards.

The air flowing along the flow space 135 can be discharged frontwards through the open front surface 131 of the air flow portion 130 as the flow pressure of the air is increased or the air is diffused. However, the air flow portion 130 may have different outflow amounts of air in a forward direction as different flow pressures are formed at locations.

In addition, in order to improve the drying efficiency of the laundry, it is possible to strategically increase the flow pressure of air in a specific region of the air flow portion 130 and increase the outflow amount of air.

Accordingly, in some implementations, the second outflow guide 1364 can be disposed in a region where the air flow pressure is too low for various reasons or in a region where the outflow amount of air needs to be increased from a strategic point of view to improve the drying efficiency or an energy efficiency.

By the second outflow guide 1364, the outflow amount of air supplied toward the air passage 230 can be increased in an entirety of the air flow portion 130, and the uniformity of the air discharged from the air flow portion 130 can be increased or an outflow amount of air at a specific location may be effectively improved.

In some implementations, the second outflow guide 1364 can be disposed on the second extended flow channel 1304.

As mentioned above, in some implementations, to improve the drying efficiency of the laundry and improve the fluidity of the air flowing into the drum 200, more air may flow from the second extended flow channel 1304 to the first extended flow channel 1302.

Therefore, the second extended flow channel 1304 can have a relatively small air flow rate in a relationship with the first extended flow channel 1302. Accordingly, the flow pressure of air in the second extended flow channel 1304 is relatively low, so that the outflow amount of air flowing frontwards may be small.

Accordingly, in some implementations, as the second outflow guide 1364 is disposed in the second extended flow channel 1304, the frontward flow of air can be formed while the air flowing through the second extended flow channel 1304 passes through the second outflow guide 1364, so that the outflow amount of air toward the air passage 230 can be effectively increased, and the uniformity of the air supplied to the air passage 230 can be improved in the entire air flow portion 130.

In some implementations, as described above, the air supply 106 can be constructed such that the space where the air is discharged from the inlet extension 138 to the flow space 135 is closer to the first extended flow channel 1302 than to the second extended flow channel 1304.

Accordingly, the air in the first extended flow channel 1302 can have a relatively high flow pressure of the air in the relationship with the second extended flow channel 1304, so that the outflow amount of air can be effectively secured. The second extended flow channel 1304 can ameliorate the flow pressure and the outflow amount of air through the second outflow guide 1364.

In some implementations, the second outflow guide 1364 may have the maximum protrusion height smaller than the depth of the flow space 135. In addition, the maximum protrusion height of the second outflow guide 1364 may be smaller than the maximum protrusion height of the first outflow guide 1362.

Unlike the first outflow guide 1362, the second outflow guide 1364 is disposed on the first extended flow channel 1302 or the second extended flow channel 1304, so that the flow rate of the air flowing past the second outflow guide 1364 needs to be secured at a certain level.

That is, the second outflow guide 1364 may have the maximum protrusion height smaller than the depth of the flow space 135 to limit the flow resistance of the air flowing through the air flow portion 130 from excessively increasing, and to allow the air to flow throughout the flow space 135 after passing through the second outflow guide 1364.

Therefore, in some implementations, the maximum protrusion height of the first outflow guide 1362 can be equal to or greater than the depth of the flow space 135, and the maximum protrusion height of the second outflow guide 1364 can be less than the depth of the flow space 135 and less than the maximum protrusion height of the first outflow guide 1362.

What is claimed is:

1. A laundry treating apparatus comprising:

a cabinet including a rear plate at a rear surface; and a drum rotatably disposed inside the cabinet and configured to receive laundry, the drum including a drum rear surface facing the rear plate, wherein the rear plate provides an air flow portion that defines a flow space configured to receive air and that includes an opening at a front surface to provide the received air to the drum rear surface, wherein the drum rear surface provides an air passage configured to receive the air from the air flow portion, wherein the air flow portion includes an air guide protruding in the flow space and configured to move the air in the air flow portion, and wherein the air guide includes an outflow guide protruding toward the air passage from a flow recessed surface, the flow recessed surface covering the flow space from a rear side of the air flow portion and configured to move the air in the flow space toward the air passage.

2. The laundry treating apparatus of claim 1, wherein the air flow portion includes (i) a flow outer circumferential surface extending along an outer circumference of the flow space and (ii) a flow inner circumferential surface extending along an inner circumference of the flow space, and wherein the outflow guide is connected to the flow outer circumferential surface and the flow inner circumferential surface.

3. The laundry treating apparatus of claim 2, wherein the air passage faces the air flow portion, and wherein a portion of the flow recessed surface curved toward the air passage is the outflow guide.

4. The laundry treating apparatus of claim 3, wherein the rear plate further includes a driver mounting portion (i) coupled to a driver from a rear side of the rear plate and (ii) surrounded by the air flow portion, the driver configured to provide a rotational force to the drum, wherein the rear plate includes a power line connected the driver mounting portion, configured to provide power to the driver, and provided at the rear side of the rear plate, and wherein the outflow guide is recessed frontward from a rear surface of the rear plate to define a space configured to receive the power line in the rear surface of the rear plate.

5. The laundry treating apparatus of claim 1, wherein the outflow guide includes:

a guide central portion protruding from the flow recessed surface toward the air passage, and a guide inclined portion extending from the guide central portion along a circumferential direction of the air flow portion, the guide inclined portion having a height of protrusion from the flow recessed surface decreasing as a distance from the guide central portion increases.

6. The laundry treating apparatus of claim 1, further comprising an air supply disposed inside the cabinet and configured to move air to the air flow portion, wherein the rear plate further includes an inlet extension extending from the air flow portion toward the air supply and configured to move the air in the air supply toward the air flow portion, and wherein the outflow guide includes a first outflow guide located on a side opposite to the inlet extension with respect to a center of the air flow portion having an annular shape.

7. The laundry treating apparatus of claim 6, wherein a maximum protrusion height of the first outflow guide is equal to or greater than a depth of the flow space.

8. The laundry treating apparatus of claim 6, wherein the outflow guide further includes a second outflow guide disposed between the inlet extension and the first outflow guide and configured to move the air in the flow space toward the air passage.

9. The laundry treating apparatus of claim 8, wherein the air flow portion includes:

a first extended flow channel extending from the inlet extension to the first outflow guide along a first direction, and a second extended flow channel extending from the inlet extension to the first outflow guide along a second direction, wherein an amount of air supplied to the second extended flow channel through the inlet extension is less than an amount of air supplied to the first extended flow channel, and wherein the second outflow guide is disposed on the second extended flow channel.

10. The laundry treating apparatus of claim 9, wherein a first distance between a discharge space for discharging the air from the inlet extension to the flow space and the first extended flow channel is less than a second distance between the discharge space and the second extended flow channel.

11. The laundry treating apparatus of claim 8, wherein a maximum protrusion height of the second outflow guide is less than a depth of the flow space.

12. The laundry treating apparatus of claim 8, wherein a maximum protrusion height of the second outflow guide is less than a maximum protrusion height of the first outflow guide.

13. The laundry treating apparatus of claim 1, further comprising an air supply disposed inside the cabinet and configured to move air to the air flow portion, wherein the rear plate further includes an inlet extension extending from the air flow portion toward the air supply and configured to move the air in the air supply toward the air flow portion, and wherein the air flow portion includes an inflow guide facing the inlet extension and configured to move the air discharged from the air supply toward the air flow portion.

14. The laundry treating apparatus of claim 13, wherein the air flow portion includes a flow inner circumferential surface having an annular shape and extending along an inner circumference of the flow space, and wherein the inflow guide is disposed on the flow inner circumferential surface and protrudes toward the air supply.

15. The laundry treating apparatus of claim 14, wherein a portion of the flow inner circumferential surface protrudes toward the air supply to define the inflow guide in the air flow portion.

16. The laundry treating apparatus of claim 15, wherein a portion of the flow inner circumference surface corresponding to the inflow guide extends in a straight line and a remaining portion of the flow inner circumference surface extends in a curved line.

17. The laundry treating apparatus of claim 15, wherein the air flow portion includes:

a first extended flow channel extending from the inlet extension along a first direction, and a second extended flow channel extending from the inlet extension along a second direction, wherein an amount of air supplied to the first extended flow channel through the inlet extension is greater than an amount of air supplied to the second extended flow channel, and wherein the inflow guide is configured to move a portion of air flowing toward the first extended flow channel toward the second extended flow channel.

18. The laundry treating apparatus of claim 17, further comprising a driver coupled to the rear plate and configured to provide a rotational force to the drum, wherein the driver is configured to rotate the drum such that an amount of rotation in the second direction of the drum is greater than an amount of rotation in the first direction of the drum in a drying process of the laundry, and wherein, based on the drum being rotated in the second direction, the air in the first extended flow channel flowing along the first direction is introduced into the drum.

19. The laundry treating apparatus of claim 17, wherein the air flow portion includes a flow outer circumferential surface extending along an outer circumference of the flow space, and wherein a width of the first extended flow channel is less than a width of the second extended flow channel.

* * * * *